US012232583B2

(12) United States Patent
Chung

(10) Patent No.: US 12,232,583 B2
(45) Date of Patent: Feb. 25, 2025

(54) CONNECTION LOCK AND WATCH BRACELET

(71) Applicant: KEITHINKETH LIMITED, Hong Kong (HK)

(72) Inventor: Hon Man Chung, Hong Kong (HK)

( * ) Notice: Subject to any disclaimer, the term of this patent is extended or adjusted under 35 U.S.C. 154(b) by 0 days.

(21) Appl. No.: 18/005,623

(22) PCT Filed: Jul. 14, 2021

(86) PCT No.: PCT/CN2021/106153
§ 371 (c)(1),
(2) Date: Jan. 16, 2023

(87) PCT Pub. No.: WO2022/012564
PCT Pub. Date: Jan. 20, 2022

(65) Prior Publication Data

US 2023/0276909 A1 Sep. 7, 2023

(30) Foreign Application Priority Data

Jul. 17, 2020 (HK) ..... 32020011571.7

(51) Int. Cl.
*A44C 5/14* (2006.01)

(52) U.S. Cl.
CPC ..... *A44C 5/14* (2013.01)

(58) Field of Classification Search
CPC .... A44C 5/14; A44C 5/24; A44C 5/02; G04B 37/1486; G04B 37/16; G04B 37/18
See application file for complete search history.

(56) References Cited

U.S. PATENT DOCUMENTS 9,901,147 B1 2/2018 Karanikos
9,989,931 B2 * 6/2018 Zhan ..... H01R 24/62
(Continued)

FOREIGN PATENT DOCUMENTS

CN 104143111 A 11/2014
CN 104678752 A 6/2015
(Continued)

OTHER PUBLICATIONS

International search report of PCT/CN2021/106153.

*Primary Examiner* — Jack W Lavinder

(57) ABSTRACT

A connection lock (100) for connection with a watch bracelet. A body portion (110) of the connection lock includes a receiving cavity (111), at least two sliding connection portions (112) and a connection opening (113). The receiving cavity (111) is enclosed by peripheral borders of the body portion (110) to receive a spare length of flexible tube or cable (400), a side border for connection with a bracelet strap (220) provided with a receiving groove (221) being provided with a notch (114) capable of matching the receiving groove (221), so as to enable the flexible tube or the cable (400) in the receiving cavity (111) to pass into the receiving groove (221) from the notch (114). The at least two sliding connection portions (112) are respectively arranged at lower edges of two opposite side borders of the body portion (110). The connection opening (113) is arranged, adjacent to the notch (114), in a side border of the body portion (110) perpendicular to the sliding connection portions (112). When an external fitting (300) connected to the flexible tube or the cable (400) is slid and connected to the sliding connection portion (112) of the connection lock (100) via a sliding portion (310) of the external fitting, a connection portion (320) of the external fitting (300) is slid in from the connection opening (113) such that the connection portion (320) is connected to the flexible tube or the
(Continued)

cable (400), facilitating mounting of the external fitting (300) to the watch bracelet assembly (200) or dismounting of the external fitting (300) from the watch bracelet assembly (200).

12 Claims, 27 Drawing Sheets

(56) References Cited

U.S. PATENT DOCUMENTS

| | | | | |
|---|---|---|---|---|
| 10,020,668 | B2 * | 7/2018 | Adamisin | G04G 19/00 |
| 10,367,300 | B2 * | 7/2019 | Shedletsky | G04G 17/04 |
| 10,461,289 | B2 * | 10/2019 | Thiel | A41D 1/005 |
| 11,575,269 | B1 * | 2/2023 | Stousland | H02J 50/10 |
| 2016/0139564 | A1 * | 5/2016 | Tsushima | A44C 5/02 368/282 |
| 2016/0291550 | A1 * | 10/2016 | Chen | H01M 10/425 |
| 2017/0000223 | A1 * | 1/2017 | Kim | A44C 5/24 |
| 2020/0301372 | A1 * | 9/2020 | Frey | G04B 37/14 |

FOREIGN PATENT DOCUMENTS

| | | | |
|---|---|---|---|
| CN | 105814752 | A | 7/2016 |
| CN | 210120930 | U | 3/2020 |
| CN | 111163660 | A | 5/2020 |

* cited by examiner

CONNECTION LOCK AND WATCH BRACELET

TECHNICAL FIELD

Embodiments of the present invention relates to the field of watches, and in particular to a connection lock for connection with a watch bracelet, and a watch bracelet.

BACKGROUND

The inventors have designed a watch bracelet assembly capable of transmitting substances of various physical properties, in order to enable the watch bracelet to transmit substances of various physical properties, such as liquid, gas, electromagnetic wave and electric current. A plurality of watch bracelet assemblies are connected to each other to form a bracelet strap having a receiving groove, so that a flexible tube or a cable can pass through the receiving groove of the bracelet strap and transmit liquid, gas, electromagnetic wave, current, etc.

However, an external device or a container or an external fitting, which is connected to the flexible tube or the cable and provides substances such as liquid, gas, electromagnetic wave and electric current, cannot be fixed in the watch or is difficult to replace.

SUMMARY

An embodiment of the present invention provides a connection lock for connection with a watch bracelet, and a watch bracelet, in order to solve or alleviate one or more of the technical problems in the prior art.

In an aspect of the embodiments of the present invention, an embodiment of the present invention provides a connection lock for connection with a watch bracelet. The connection lock includes a body portion. The body portion includes a receiving cavity, at least two sliding connection portions and a connection opening. The receiving cavity is enclosed by peripheral borders of the body portion to receive a spare length of flexible tube or cable, a side border for connection with a bracelet strap provided with a receiving groove being provided with a notch capable of matching the receiving groove, so as to enable the flexible tube or the cable in the receiving cavity to pass into the receiving groove from the notch. The at least two sliding connection portions are respectively arranged at lower edges of two opposite side borders of the body portion. The connection opening is arranged, adjacent to the notch, in a side border of the body portion perpendicular to the sliding connection portions, wherein when an external fitting connected to the flexible tube or the cable is slid and connected to the sliding connection portion of the connection lock via a sliding portion of the external fitting, a connection portion of the external fitting is slidable in from the connection opening such that the connection portion is connected to the flexible tube or the cable in the receiving cavity. The arrangement of the connection opening and the notch can enable the flexible tube or the cable to be flexed into a U-shape in the receiving cavity, so that one end of the flexible tube or the cable can pass through the notch and the other end can be connected to the connection portion of the external fitting that is slid in from the connection opening.

In an aspect of the embodiments of the present invention, an embodiment of the present invention provides a watch bracelet, including at least one bracelet strap and the connection lock as described above, wherein the bracelet strap is provided with a receiving groove, the end of the connection lock provided with the notch is connected to a first end of the bracelet strap provided with the receiving groove, and the notch of the connection lock matches the receiving groove of the bracelet strap.

In some embodiments, the watch bracelet further includes a grooved bracelet fastener, a rear part of the grooved bracelet fastener being connected to a second end of the bracelet strap, and the grooved bracelet fastener being provided with a shaft groove which transversely penetrates a front part of the grooved bracelet fastener and which is recessed downwardly along an upper surface of the grooved bracelet fastener, and a sliding elastic cover arranged above the shaft groove, wherein the sliding elastic cover is configured to open or close the shaft groove, and the shaft groove is configured to accommodate a connection shaft of a watch body.

In an aspect of the embodiments of the present invention, an embodiment of the present invention provides an external fitting, including: a body of the external fitting, a connection portion arranged on a surface of the body of the external fitting, and at least two sliding portions corresponding to the at least two sliding connection portions of the connection lock as described above, wherein when the sliding portions of the external fitting are slid and connected to the sliding connection portions of the connection lock, the connection portion is slidable in from the connection opening of the connection lock.

In the embodiments of the present invention, by adopting the above technical schemes, the external fitting of a watch can be replaced and the external fitting can be fixed on the connection lock of the watch bracelet after replacement. In addition, it is possible to provide a grooved bracelet fastener at the other end of the watch bracelet, so as to facilitate the replacement of a watch body.

The foregoing summary is only for illustration and is not intended to be limiting in any way. In addition to the illustrative aspects, embodiments, and features described above, further aspects, embodiments, and features of the present disclosure will become apparent with reference to the accompanying drawings and the following detailed description.

BRIEF DESCRIPTION OF DRAWINGS

In the accompanying drawings, the same reference numerals throughout the figures indicate the same or similar components or elements unless otherwise specified. The accompanying drawings are not necessarily drawn to scale. It should be understood that these accompanying drawings depict only some embodiments of the present disclosure and should not be considered as limiting the scope of the present disclosure.

LIST OF REFERENCE NUMERALS

100. Connection lock;

110. Body portion; 1101. First side border; 1102. Second side border; 1103 Third side border; 1104. Fourth side border; 111. Receiving cavity; 112. Sliding connection portion; 113. Connection opening; 114. Notch; 115. Stopper; 116. First end of the body portion 110; 117. Second end of the body portion 110; 118. First pin portion; 119. Second pin portion;

120. Lock brake; 121. First end of the lock brake 120; 122. Second end of the lock brake 120; 123. Stop plates of two side borders of the lock brake 120; 138. Cover surface of the lock brake 120;

130. Frame portion; 131. First end of the frame portion 130; 132. Second end of the frame portion 130; 133. First hole; 134. Second hole; 135. First inclined surface; 136. Second inclined surface; 137. Cover surface of the frame portion 130;

200. Watch bracelet assembly;

210. Grooved bracelet fastener;

211. Shaft groove; 212. Sliding elastic cover; 213. First opening; 214. Second opening;

220. Bracelet strap; 221. Receiving groove;

300. External fitting;

310. Sliding portion; 320. Connection portion; 330. Body of the external fitting 300;

400. Flexible tube or cable;

500. Watch body; 510. Connection shaft.

DETAILED DESCRIPTION

Hereinafter, some embodiments are briefly described by way of example only. As will be appreciated by those skilled in the art, the embodiments described may be modified in various ways without departing from the principle or scope of the present disclosure. Therefore, the accompanying drawings and descriptions are regarded as illustrative in nature rather than restrictive.

Figure 9:
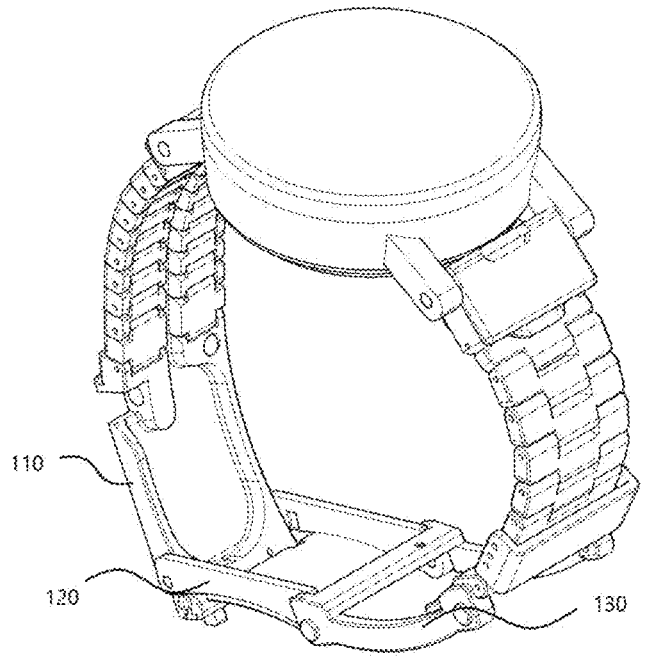
FIG. 9 shows a perspective view of a connection lock after being fully opened according to an embodiment of the present invention.
Figure 10:
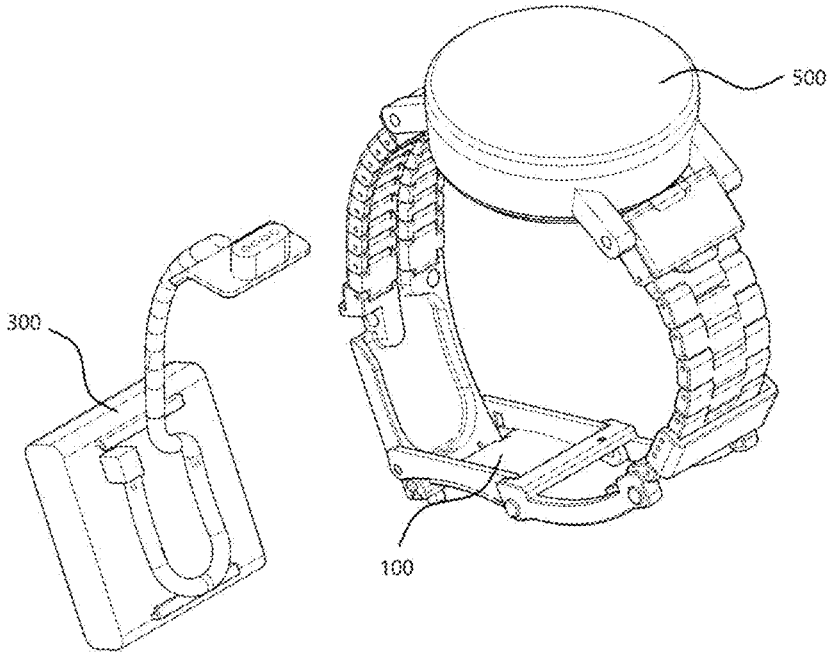
FIG. 10 shows a perspective view of an external fitting ready to be mounted to a watch bracelet assembly according to an embodiment of the present invention.
Figure 30:
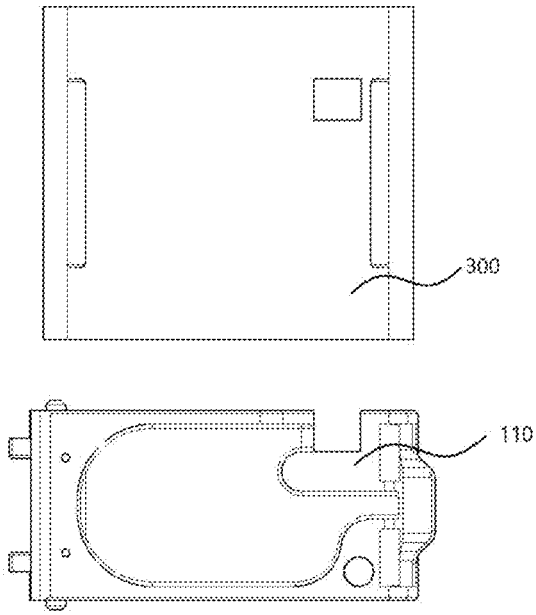
FIG. 30 shows a top view of a sliding connection portion of a body portion of a connection lock aligned with a sliding portion of an external fitting according to an embodiment of the present invention.
Figure 31:
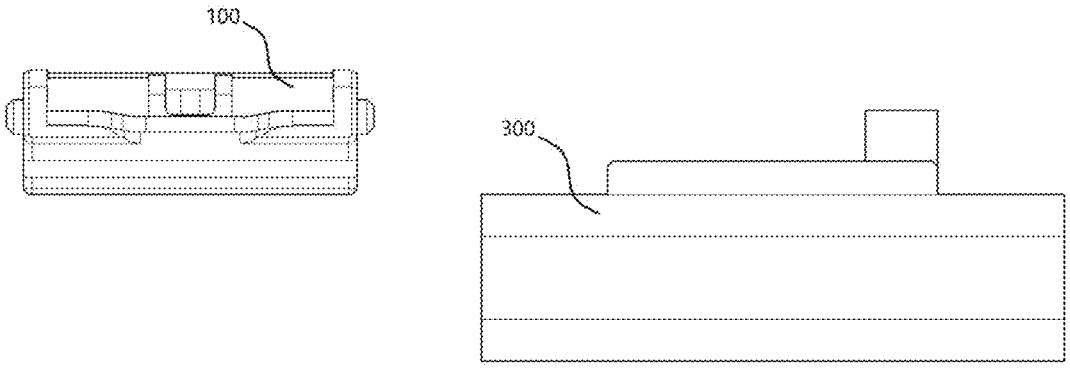
FIG. 31 shows a front view of a sliding connection portion of a body portion of a connection lock aligned with a sliding portion of an external fitting according to an embodiment of the present invention.
Figure 32:
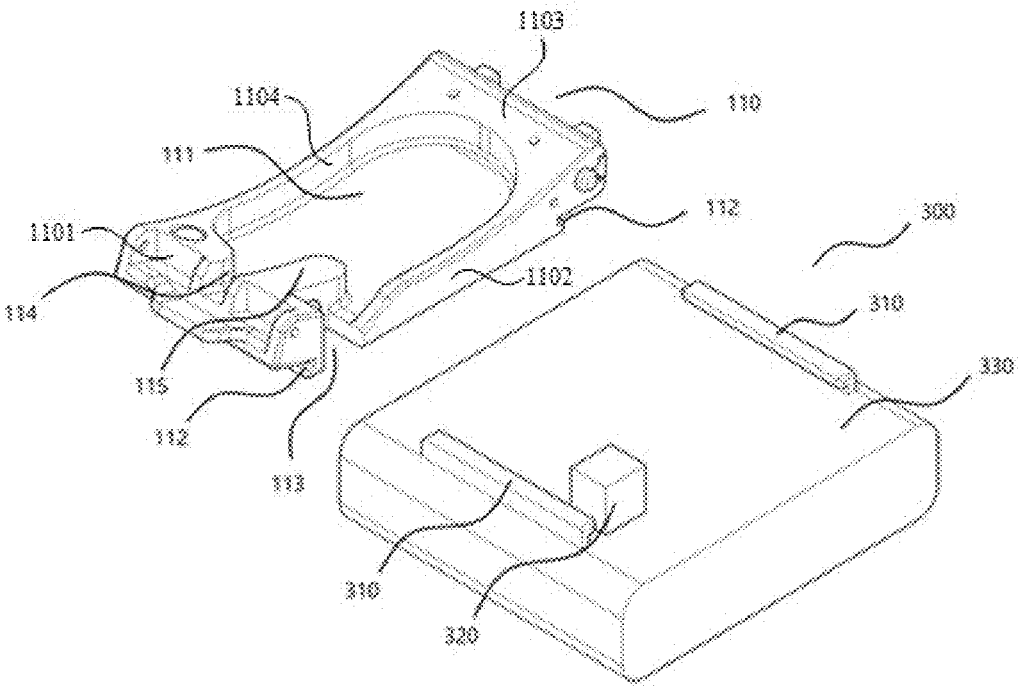
FIG. 32 shows a perspective view of a sliding connection portion of a body portion of a connection lock aligned with a sliding portion of an external fitting according to an embodiment of the present invention.
Figure 33:
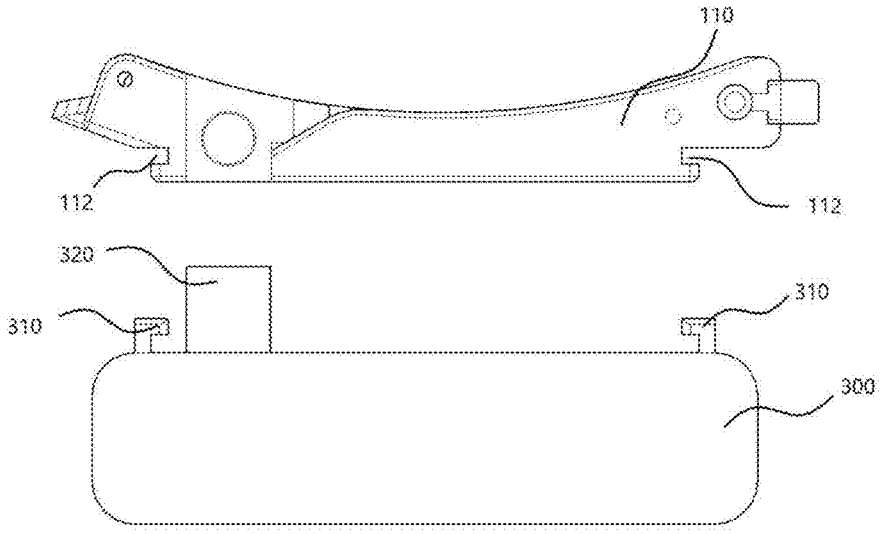
FIG. 33 shows a front view of a body portion of a connection lock after being vertically aligned with an external fitting according to an embodiment of the present invention.
Figure 34:
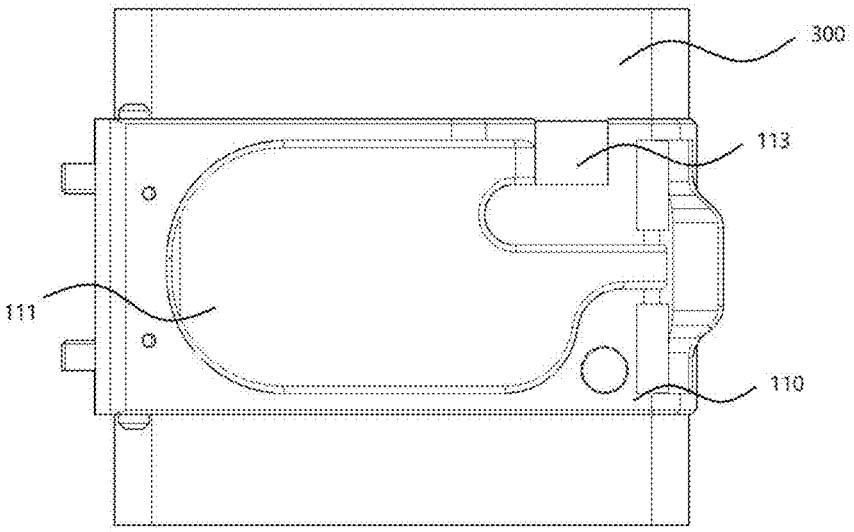
FIG. 34 shows a top view of an external fitting connected to a body portion of a connection lock according to an embodiment of the present invention.
Figure 35:
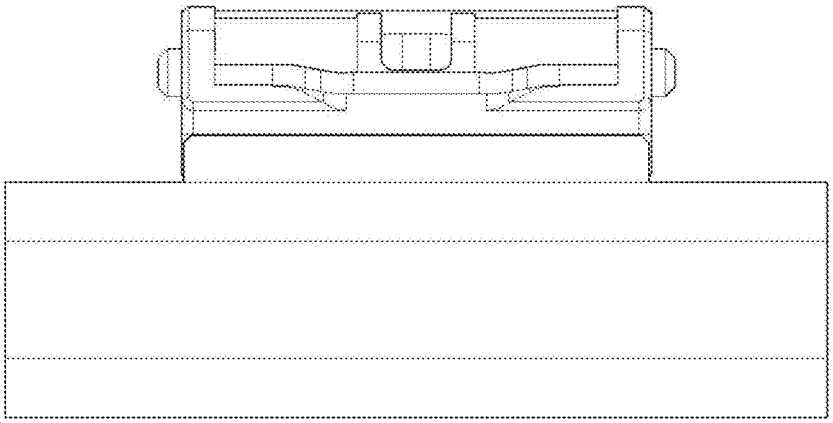
FIG. 35 shows a left side view of an external fitting connected to a body portion of a connection lock according to an embodiment of the present invention.
Figure 36:
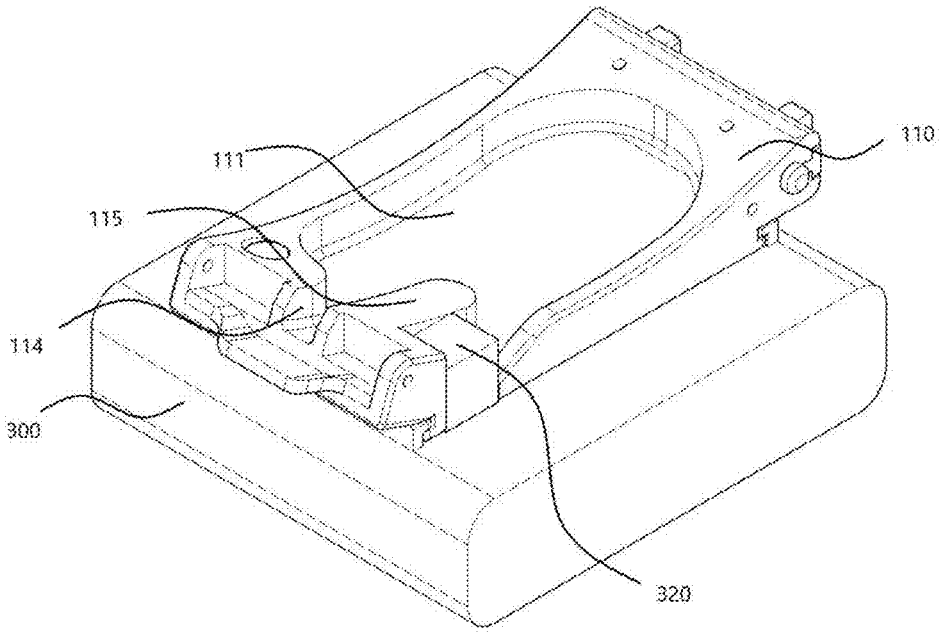
FIG. 36 shows a perspective view of an external fitting connected to a body portion of a connection lock according to an embodiment of the present invention.
Figure 37:
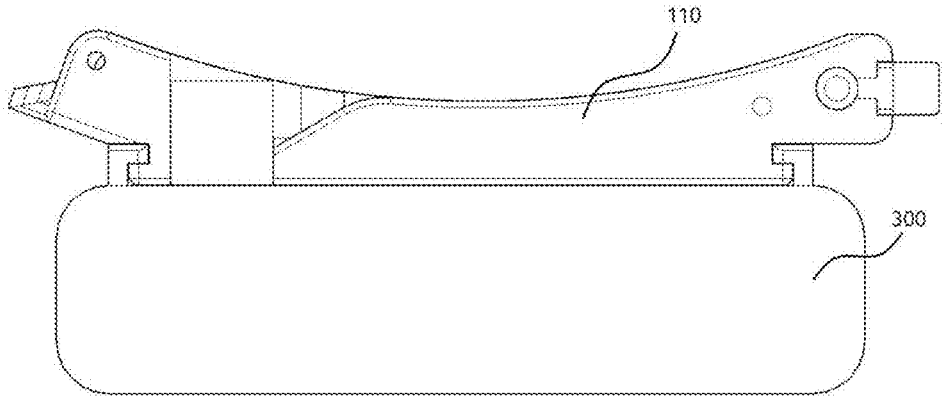
FIG. 37 shows a front view of an external fitting connected to a body portion of a connection lock according to an embodiment of the present invention.
Figure 38:
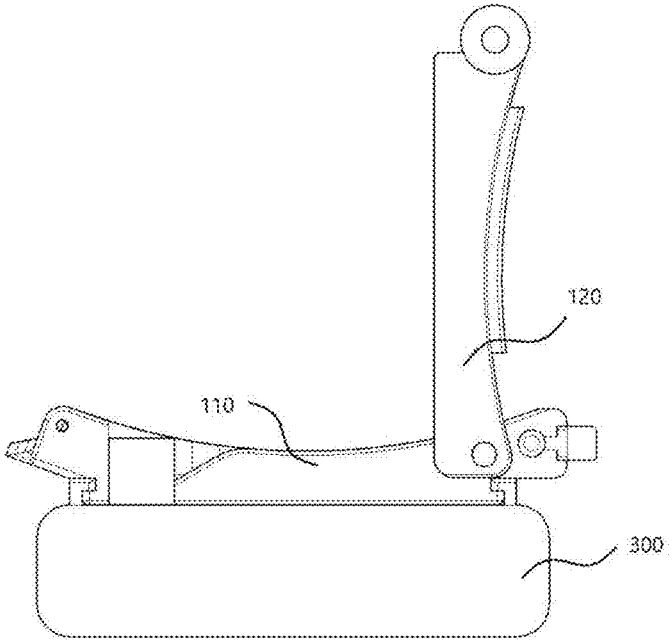
FIG. 38 shows a front view of a lock brake connected to a body portion and in an open state according to an embodiment of the present invention.
Figure 39:
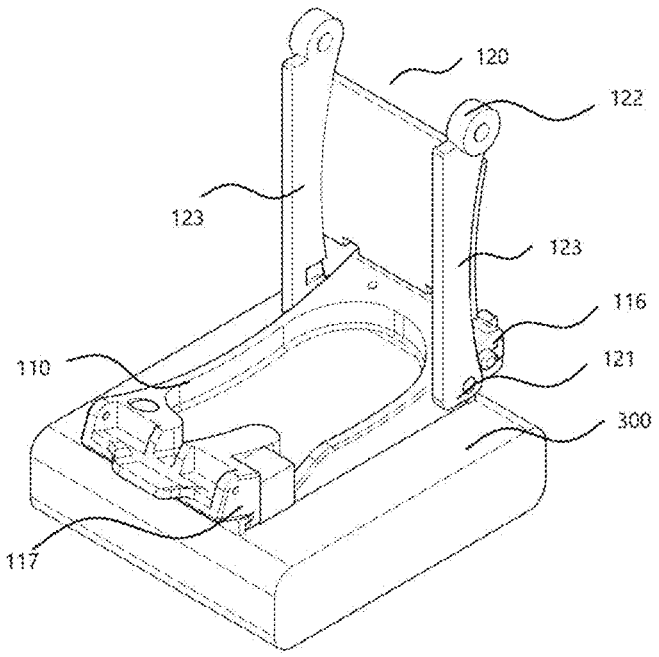
FIG. 39 shows a perspective view of a lock brake connected to a body portion and in an open state according to an embodiment of the present invention.
Figure 40:
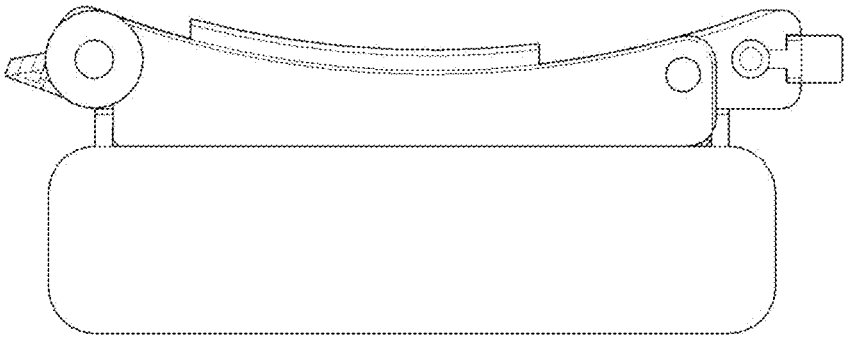
FIG. 40 shows a front view of a lock brake covering a body portion according to an embodiment of the present invention.
Figure 41:
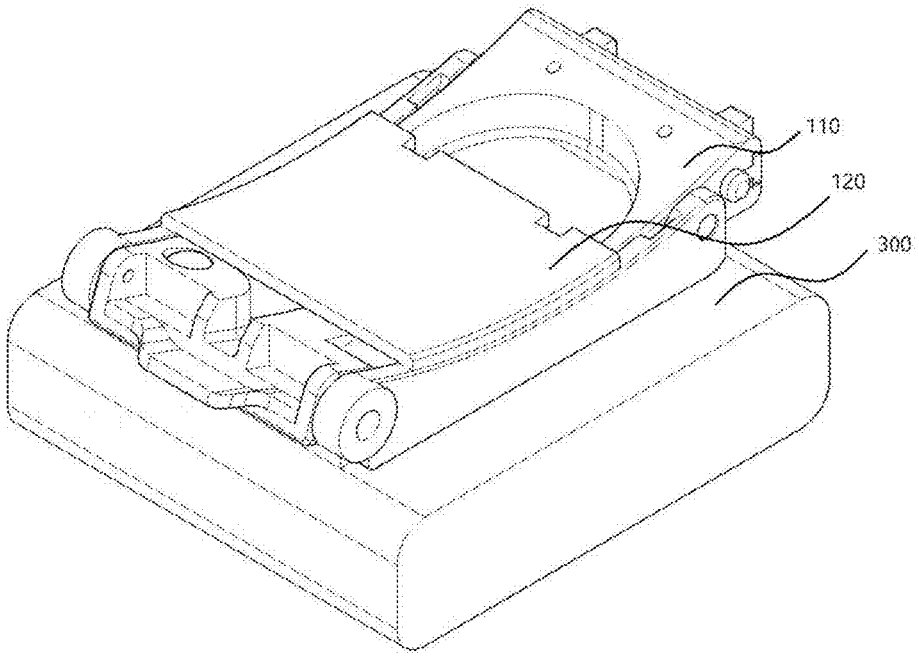
FIG. 41 shows a perspective view of a lock brake covering a body portion according to an embodiment of the present invention.

In an exemplary implementation, FIGS. 30 to 32 show a top view, a front view, and a perspective view of a sliding connection portion of a body portion of a connection lock aligned with a sliding portion of an external fitting according to an embodiment of the present invention, and FIG. 33 shows a front view of the body portion of the connection lock after being vertically aligned with the external fitting according to the embodiment of the present invention. As shown in FIG. 32, the connection lock 100 provided in the embodiment of the present invention is configured for connection with one end of a watch bracelet assembly 200. As shown in FIGS. 9 and 10, the connection lock 100 may include a body portion 110, a lock brake 120, and a frame portion 130. As shown in FIG. 32, the body portion 110 includes a receiving cavity 111, at least two sliding connection portions 112 and a connection opening 113. The receiving cavity 111 is enclosed by peripheral borders of the body portion 110 to receive a spare length of flexible tube or cable 400. A side border for connection with a bracelet strap 220 provided with a receiving groove 221 is provided with a notch 114. The notch 114 is configured to match the receiving groove 221 of the bracelet strap 220, so as to enable the flexible tube or the cable 400 in the receiving cavity 111 to pass into the receiving groove 221 from the notch 114. The flexible tube or the cable 400 may transmit liquid, gas, electric current, etc. The sliding connection portions 112 are provided at lower edges of two opposite side borders of the body portion 110. An objective of the present invention is to enable the external fitting 300 of the watch bracelet to be detachably connected to the connection lock 100. Therefore, the two sliding connection portions 112 correspond to, for example, are adapted in terms of position and shape to, sliding portions 310 provided on the external fitting 300. As shown in FIGS. 48A-48F, the sliding connection portion 112 may be a sliding groove, and the sliding portion 310 of the external fitting 300 may be a sliding rail. Alternatively, the sliding connection portion 112 is a sliding rail, and the sliding portion 310 of the external fitting 300 is a sliding groove. Alternatively, the sliding connection portion 112 and the sliding portion 310 of the external fitting 300 are linear sliding connection structures having interlocking shapes.

A connection opening 113 may be arranged, adjacent to the notch 114, in a side border of the body portion 110 perpendicular to the sliding connection portion 112, so that it is convenient for the connection portion 320 of the external fitting 300 to be slid in from the connection opening 113. The connection portion 320 is a connection component, which is connected to the flexible tube or the cable 400 in the receiving cavity 111 at the position of the connection opening 113. Alternatively, the connection portion is slid into the connection opening 113 in a state where it is connected to the flexible tube or the cable 400, and the flexible tube or the cable 400 to which it is connected is received in the receiving cavity 111. When the external fitting 300 is slid and connected to the sliding connection portion 112 of the connection lock 100 via the sliding portion 310 thereof, the connection portion 320 is slid in from the connection opening 113 so as to communicate with the receiving cavity 111, the connection portion 320 just seals the connection opening 113, and a border close to the port of the connection portion 320 connected to the flexible tube or the cable 400 forms an inclined edge extending upwardly from the bottom edge of the connection opening 113, thereby facilitating the sliding of the connection portion 320 of the external fitting 300 into the connection opening 113 in the state where it is connected to the flexible tube or the cable 400.

Figure 18:
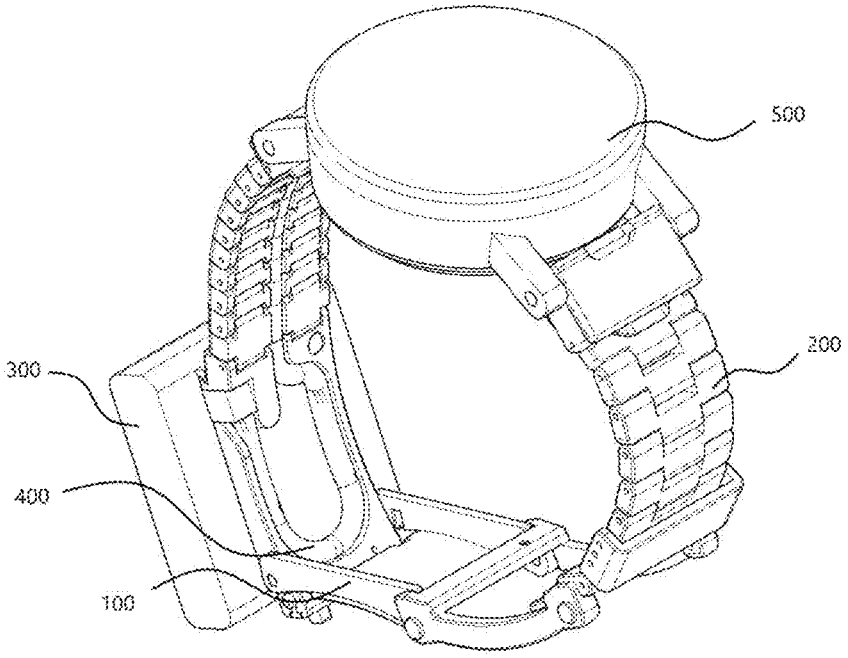
FIG. 18 shows a perspective view of a fully-opened connection lock to which an external fitting is mounted according to an embodiment of the present invention.
Figure 19:
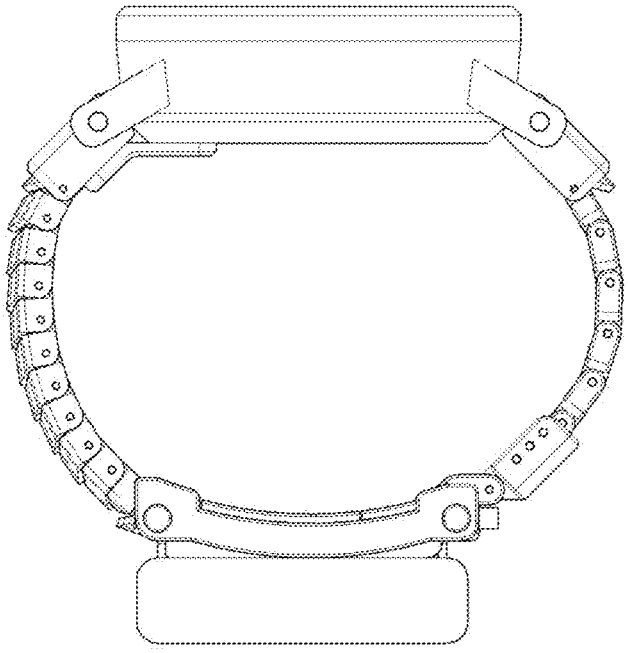
FIG. 19 shows a front view of a watch according to an embodiment of the present invention in which an external fitting is connected and a connection lock is closed and locked.
Figure 20:
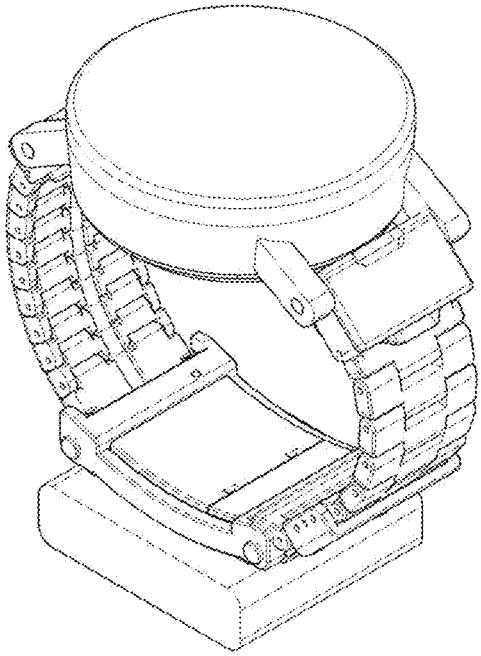
FIG. 20 shows a perspective view of a watch according to an embodiment of the present invention in which an external fitting is connected and a connection lock is closed and locked.
Figure 21:
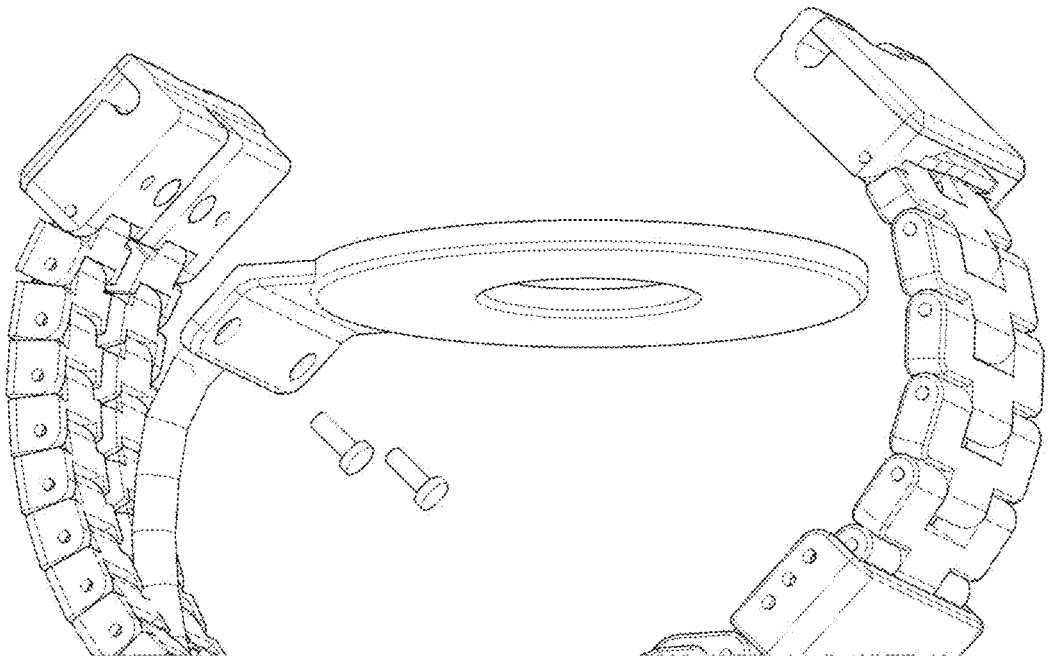
FIG. 21 shows a perspective view of a wireless charging board ready to be screwed to the bottom of a grooved bracelet fastener according to an embodiment of the present invention.
Figure 22:
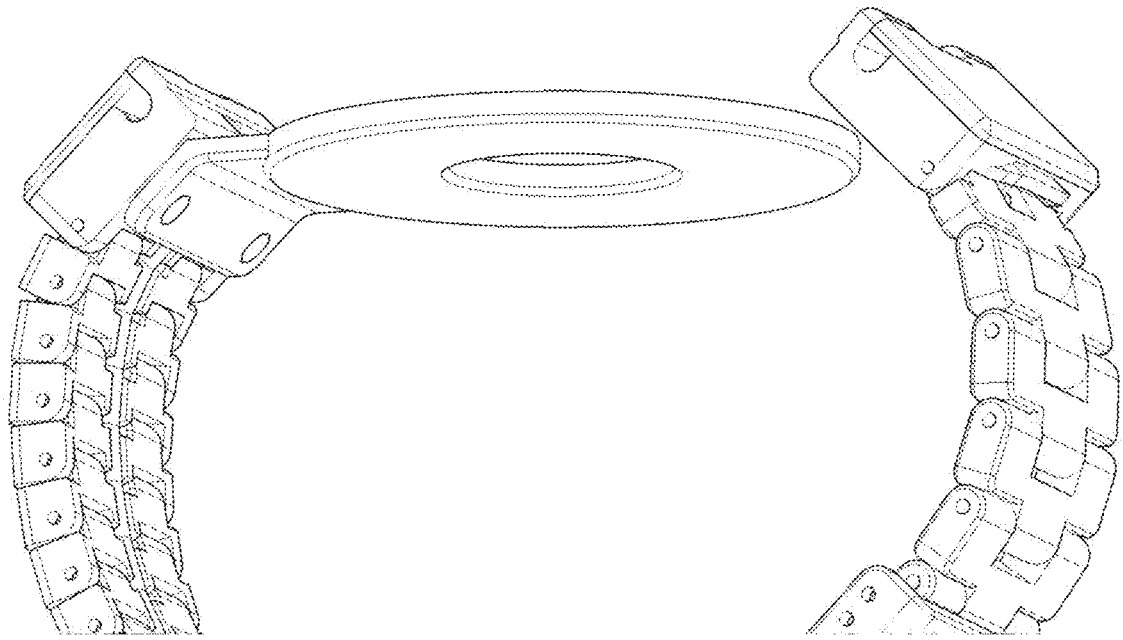
FIG. 22 shows a perspective view of a wireless charging board that has been screwed to the bottom of a grooved bracelet fastener according to an embodiment of the present invention.
Figure 23:
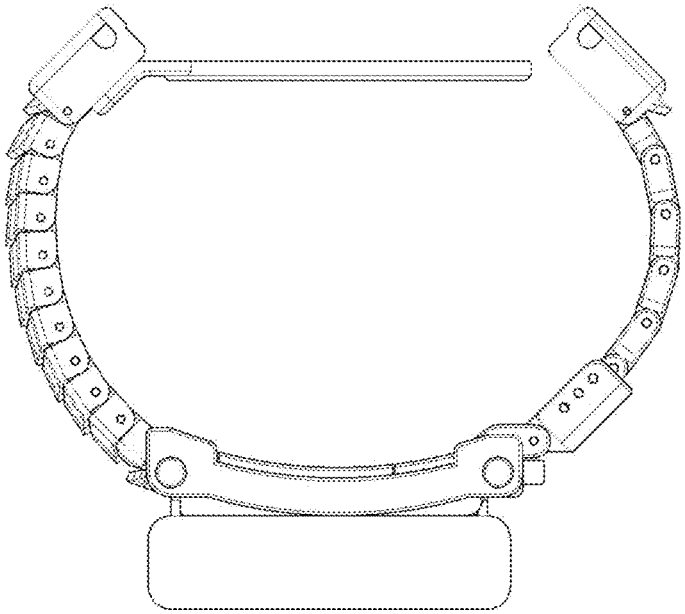
FIG. 23 shows a front view of a watch bracelet assembly to which an external fitting and a wireless charging board are mounted according to an embodiment of the present invention.
Figure 24:
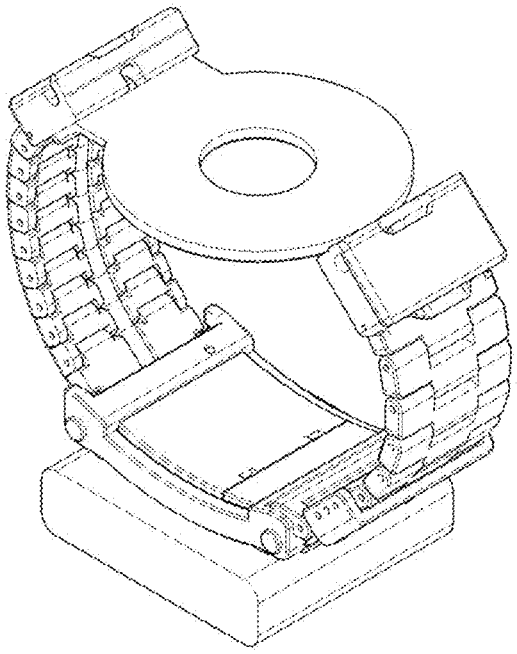
FIG. 24 shows a perspective view of a watch bracelet assembly to which an external fitting and a wireless charging board are mounted according to an embodiment of the present invention.
Figure 25:
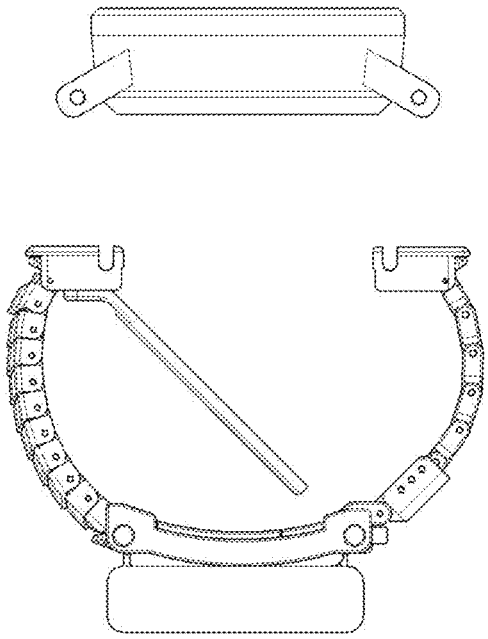
FIG. 25 shows a front view of a watch bracelet assembly to which an external fitting and a wireless charging board are mounted ready to be connected to a watch body according to an embodiment of the present invention.
Figure 26:
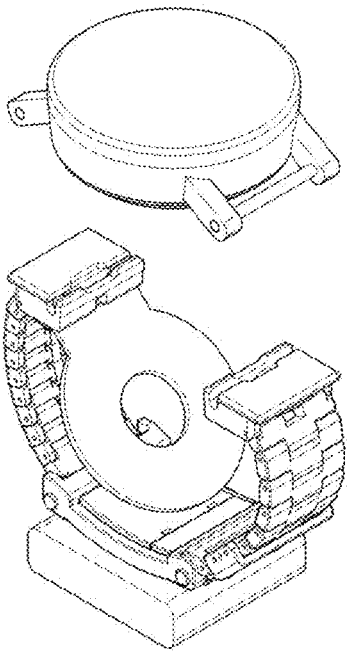
FIG. 26 shows a perspective view of a watch bracelet assembly to which an external fitting and a wireless charging board are mounted ready to be connected to a watch body according to an embodiment of the present invention.
Figure 27:
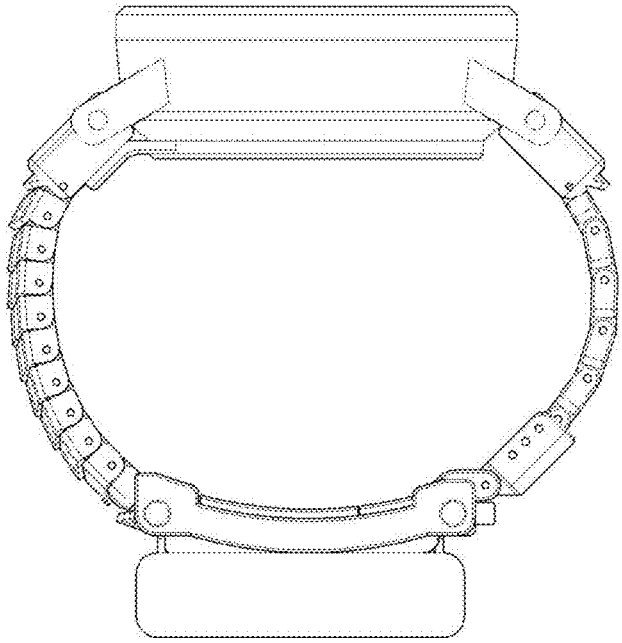
FIG. 27 shows a front view of a watch bracelet assembly to which an external fitting, a wireless charging board and a watch body are mounted according to an embodiment of the present invention.
Figure 28:
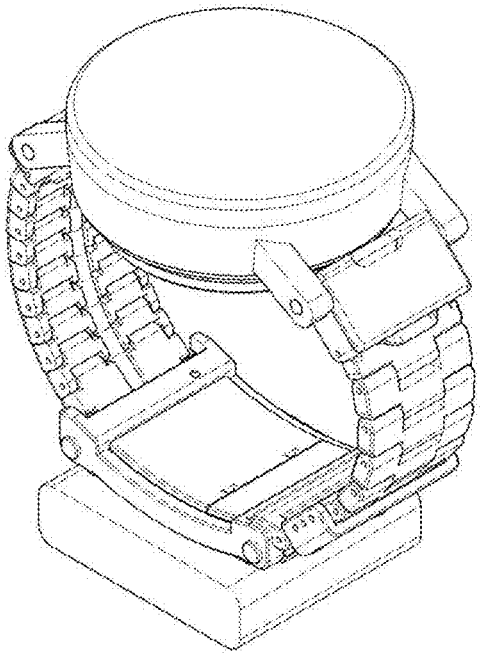
FIG. 28 shows a right perspective view of a watch bracelet assembly to which an external fitting, a wireless charging board and a watch body are mounted according to an embodiment of the present invention.
Figure 29:
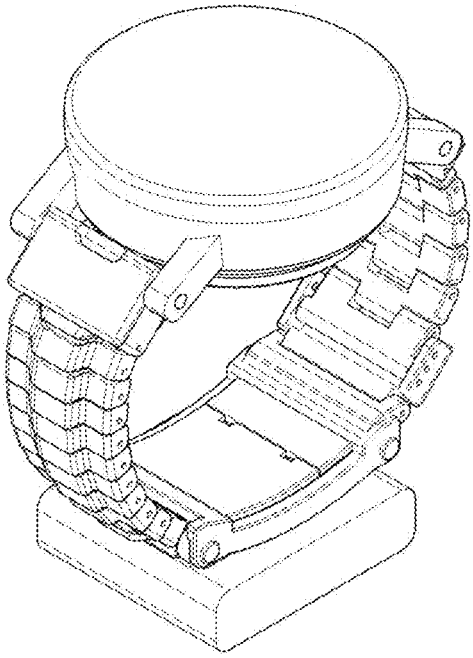
FIG. 29 shows a left perspective view of a watch bracelet assembly to which an external fitting, a wireless charging board and a watch body are mounted according to an embodiment of the present invention.

As shown in FIG. 18, the arrangement of the connection opening 113 and the notch 114 can enable the flexible tube or the cable 400 to be flexed into a U-shape in the receiving cavity 111, so that one end of the flexible tube or the cable 400 can pass through the notch 114 and the other end can be connected to the connection portion 320 of the external fitting 300 that is slid in from the connection opening 113.

As shown in FIG. 32, the two sliding portions 310 of the external fitting 300 may be aligned with the two sliding connection portions 112 of the body portion 110 of the connection lock 100, the sliding portions 310 are then slid into the sliding connection portions 112, and the connection portion 320 of the external fitting 300 positioned in the same plane as the sliding portions 310 is also slid into the connection opening 113 accordingly. As shown in FIGS. 34 to 37, a top view, a left side view, a perspective view and a front view of the external fitting 300 after being connected to the body portion 110 of the connection lock 100 are shown. This connection opening 113 is in communication with the receiving cavity 111, and the flexible tube or the cable 400 located in the receiving cavity 111 can pass into the connection opening 113 and be connected to the connection portion 320 of the external fitting 300. In this way, the external fitting 300 can be fixed to the connection lock 100, and a corresponding physical substance can be transferred through the flexible tube or the cable 400 on the connection lock 100 and the bracelet strap to a device to which the other end of the bracelet strap is connected. For example, the external fitting 300 is a battery case loaded below the connection lock 100 and connected to a cable. The cable is received in the receiving cavity 111, passes through the notch 114 and the receiving groove 221, and is connected to a charging port of a watch body 500. Therefore, the battery case can supply power to the watch body 500 for charging through the cable.

As shown in FIG. 32, a stopper 115 may be provided at the bottom of the connection opening 113 of the connection lock 100. The stopper 115 has a first end close to the notch 114, a second end close to the connection opening 113, and a semicircular arc-shaped third end extending to the side opposite to the notch 114, so as to enable the flexible tube or the cable 400 to be flexed into a U-shape to a minimum extent in the receiving cavity 111, so that one end of the flexible tube or the cable 400 can pass through the notch 114 and the other end can be connected to the connection portion 320 of the external fitting 300 that is slid in from the connection opening 113. After the sliding portions 310 of the external fitting 300 are completely slid into the sliding connection portions 112 of the body portion 110, the stopper 115 at the bottom of the connection opening 113 can prevent the further sliding of the connection portion 320, that is, prevent the sliding portions 310 from sliding out from the other end of the sliding connection portions 112.

In some embodiments, the stopper 115 may be magnetic. For example, the stopper 115 is a magnet, and the connection portion 320 may also be a magnet, or the connection portion 320 may be made of a material that can be attracted by the magnet.

As shown in FIGS. 38 to 41, the connection lock 100 may further include a lock brake 120. A first end 121 of the lock brake 120 is pivotally connected to the first end 116 (a side border) of the body portion 110. The side borders at the first end 116 and the second end 117 (a side border having the notch) of the body portion 110 are opposite to each other, and the second end 117 of the body portion 110 is connected to the watch bracelet assembly. Two side borders of the lock brake 120 perpendicular to the sliding connection portion 112 of the body portion 110 are both provided with stop plates 123 extending downwardly perpendicular to a cover surface 138 of the lock brake 120. The cover surface 138 of the lock brake 120 may partially or completely cover the receiving cavity 111 of the body portion 110. When the lock brake 120 covers over the receiving cavity 111 of the body portion 110, the stop plates 123 of the two side borders of the lock brake 120 cover two ends of the two sliding connection portions 112, so that the sliding portions 310 of the external fitting 300 can be prevented from sliding out of the sliding connection portions 112 of the body portion 110 after the sliding portions 310 are slid into the sliding connection portions 112. In addition, one of the stop plates 123 also covers the connection opening 113 of the body portion 110 to prevent the connection portion 320 from sliding out of the connection opening 113.

The side borders at the first end 121 and the second end 122 of the lock brake 120 are opposite each other. When the lock brake 120 is pivoted about the first end 116 of the body portion 110, that is, the side border remote from the bracelet strap 220 to which the body portion 110 is connected, and covers over the receiving cavity 111 of the body portion 110, the second end 122 of the lock brake 120 is close to the bracelet strap 220 to which the body portion 110 is connected.

Figure 42:
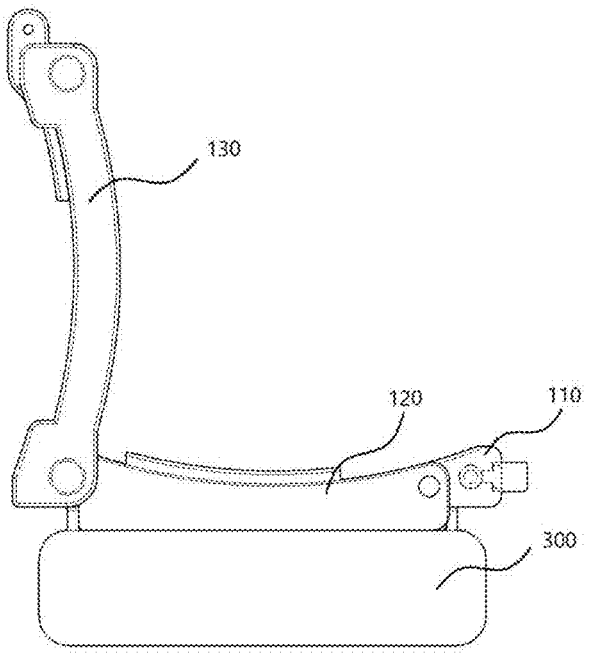
FIG. 42 shows a front view of a frame portion connected to a lock brake and in an open state according to an embodiment of the present invention.
Figure 43:
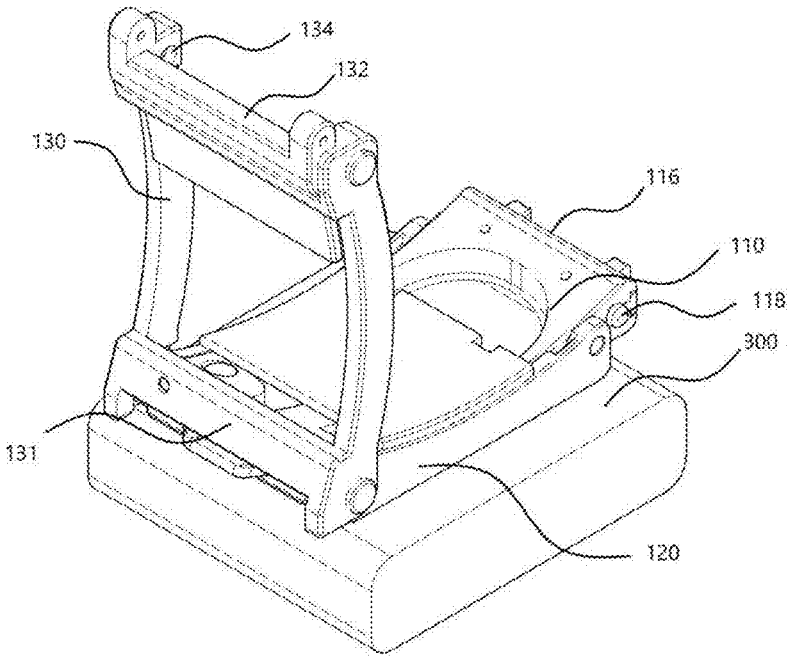
FIG. 43 shows a rear perspective view of a frame portion connected to a lock brake and in an open state according to an embodiment of the present invention.
Figure 44:
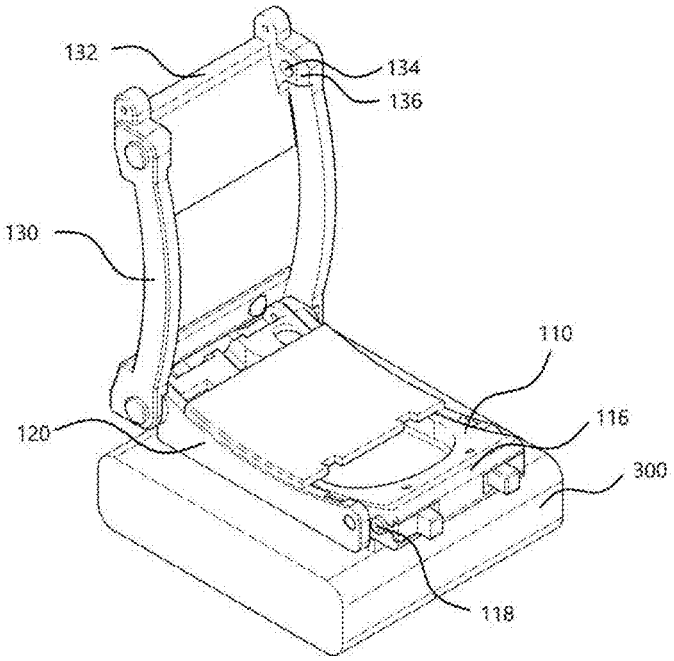
FIG. 44 shows a front right perspective view of a frame portion connected to a lock brake and in an open state according to an embodiment of the present invention.

As shown in FIGS. 42 to 44, the connection lock 100 may further include a frame portion 130 provided with peripheral borders. A first end 131 of the frame portion 130 is pivotally connected to the second end 122 of the lock brake 120. After the lock brake 120 covers over the receiving cavity 111 of the body portion 110, the frame portion 130 may be pivoted about the second end 122 of the lock brake 120 to frame the lock brake 120 and the body portion 110, a second end 132 of the frame portion 130 is detachably connected to the first end 116 of the body portion 110, and the second end 132 of the frame portion 130 is connected to the bracelet strap 220 of the watch bracelet. If the cover surface 138 of the lock brake 120 can only partially cover the receiving cavity 111 of the body portion 110, a cover surface 137 for the remaining part may be provided on the frame portion 130 to be assembled with the cover surface 138 of the lock brake 120 so that the two cover surfaces can completely cover the receiving cavity 111 of the body portion 110 when the connection lock 100 is completely closed. For example, the ratio of an area in which the cover surface 138 of the lock brake 120 covers the body portion to an area in which the cover surface 137 of the frame portion 130 covers the body portion is 6:4.

The side borders at the first end 131 and the second end 132 of the frame portion 130 are opposite to each other. The first end 131 of the frame portion 130 is pivotally connected to the second end 122 of the lock brake 120, and the second end 132 of the frame portion 130 is connected to a bracelet strap on the other side of the watch bracelet. When the lock brake 120 covers over the receiving cavity 111 of the body portion 110, the second end 122 of the lock brake 120 is close to the bracelet strap 220 to which the body portion 110 is connected. At the same time, the first end 131 of the frame portion 130 pivotally connected to the second end 122 of the lock brake 120 is also close to the bracelet strap 220 to which the body portion 110 is connected. After the lock brake 120 covers over the receiving cavity 111 of the body portion 110, the frame portion 130 is pivoted about the second end 122 of the lock brake 120 and frames the lock brake 120 and the body portion 110. The second end 132 of the frame portion 130 is close to the first end 121 of the lock brake 120 and fixed to the first end 116 of the body portion 110.

Figure 45:
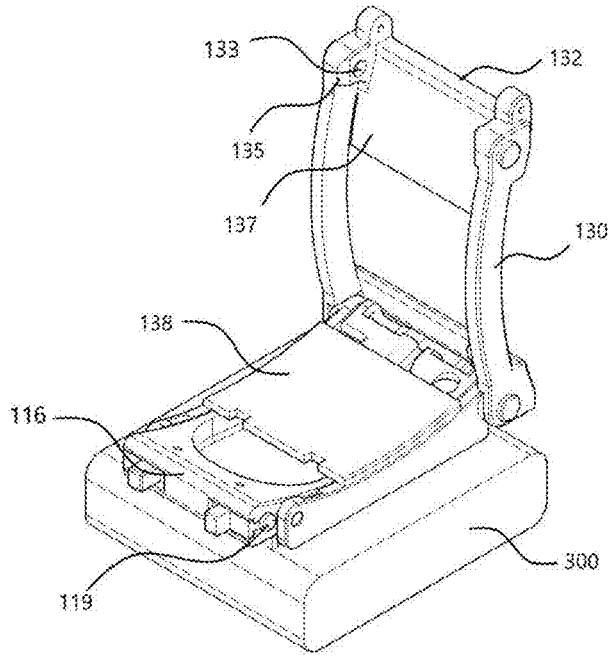
FIG. 45 shows a front left perspective view of a frame portion connected to a lock brake and in an open state according to an embodiment of the present invention.
Figure 46:
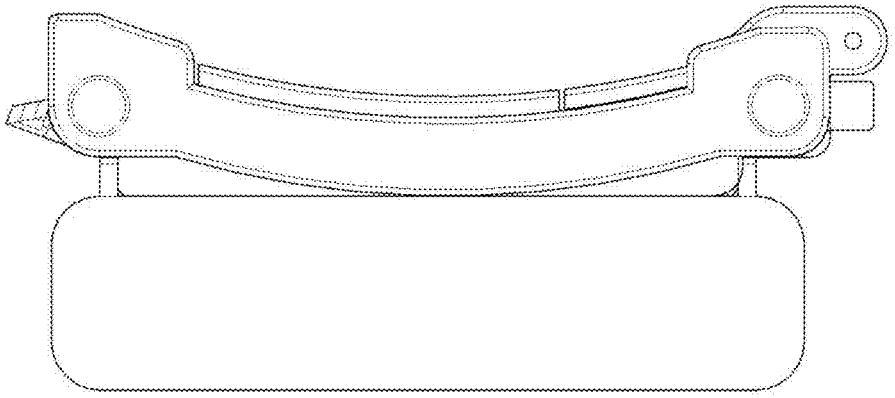
FIG. 46 shows a front view of a connection lock fully closed to lock an external fitting according to an embodiment of the present invention.
Figure 47:
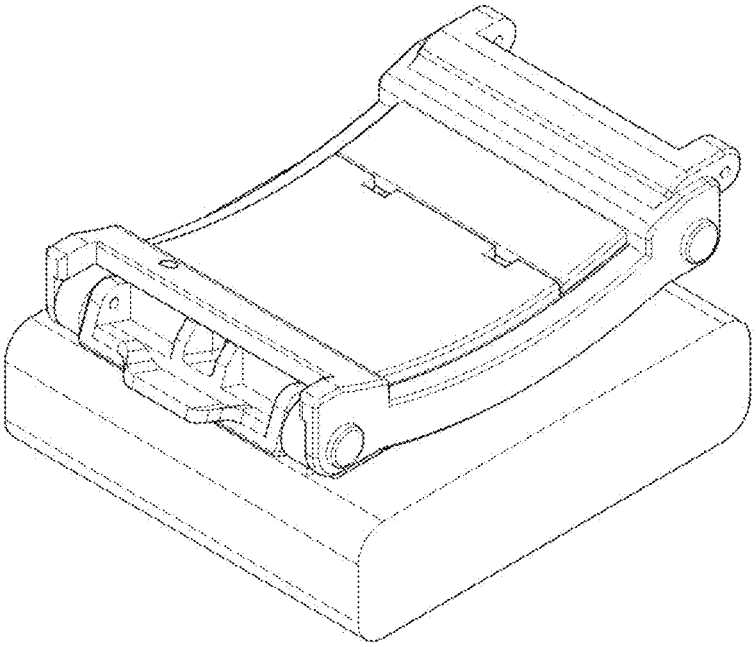
FIG. 47 shows a perspective view of a connection lock fully closed to lock an external fitting according to an embodiment of the present invention.
Figure 48A:
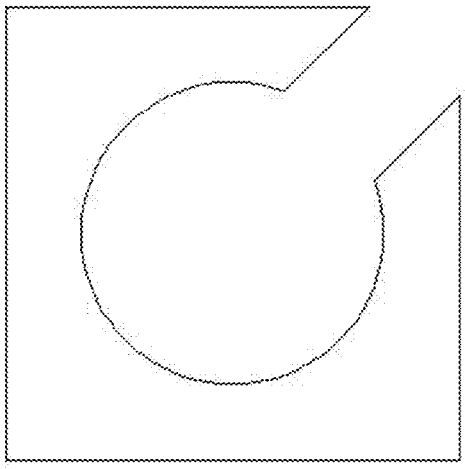
FIGS. 48A-48F show schematic views of a sliding portion and a sliding connection portion according to an embodiment of the present invention.
Figure 48B:
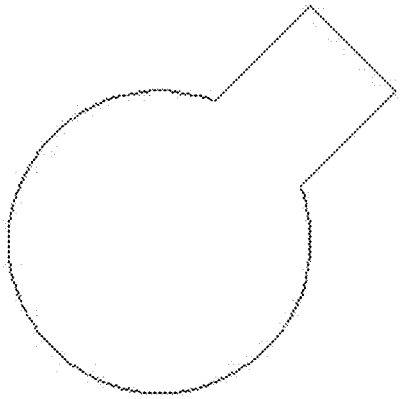
Figure 48C:
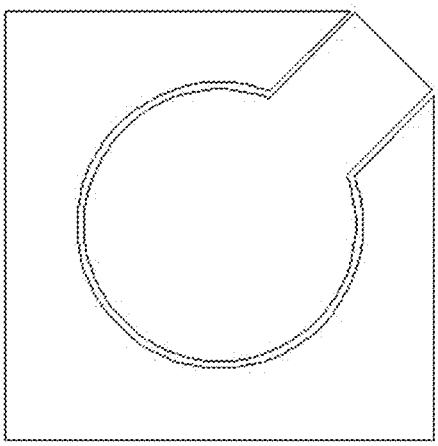
Figure 48D:
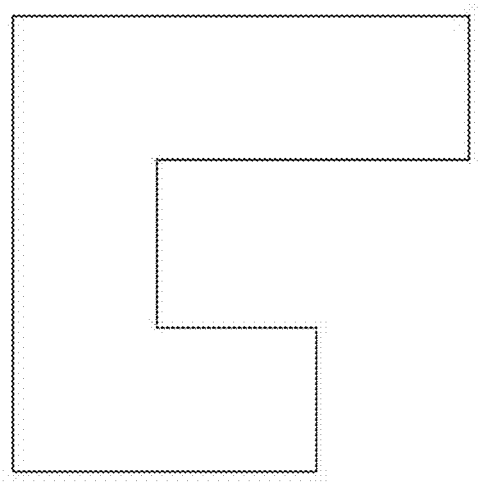
Figure 48E:
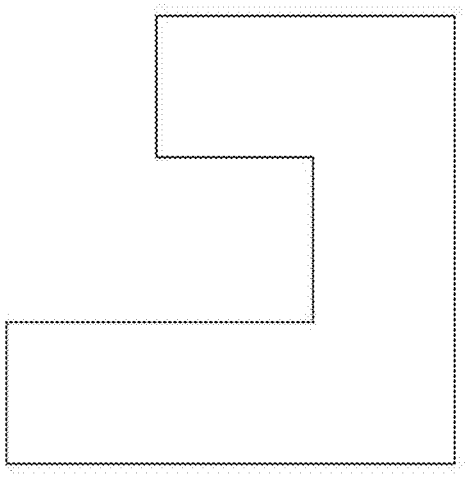
Figure 48F:
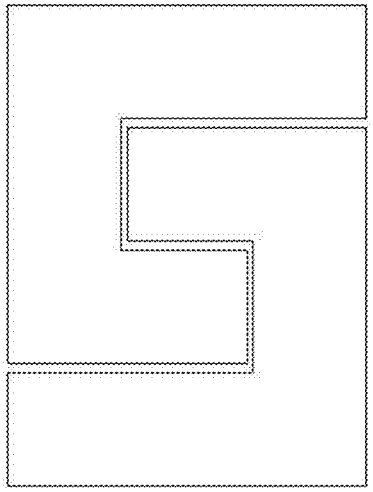

As shown in FIGS. 43, 44 and 45, a first pin portion 118 and a second pin portion 119 are respectively provided on two sides of the first end 116 of the body portion 110. Axes of the first pin portion 118 and the second pin portion 119 coincide with each other. A first hole 133 corresponding to the first pin portion 118 and a second hole 134 corresponding to the second pin portion 119 are respectively provided on two sides of the second end 132 of the frame portion 130. Axes of the first hole 133 and the second hole 134 coincide with each other. When the frame portion 130 is pivoted about the second end 122 of the lock brake 120 to frame the lock brake 120 and the body portion 110, the first pin portion 118 of the body portion 110 is inserted into the first hole 133 of the frame portion 130, and the second pin portion 119 of the body portion 110 is inserted into the second hole 134 of the frame portion 130. In this way, the external fitting 300 can be locked in the connection lock 100. As shown in FIGS. 46 and 47, the external fitting 300 is locked in the connection lock 100.

In order to make it possible for the pin portions of the body portion 110 to smoothly slide into the holes of the frame portion 130, in a plane where the first hole 133 is located, a first inclined surface 135 connected to the plane is provided in a direction in which the frame portion 130 is pivoted toward the body portion 110, and the first inclined surface 135 is inclined downwardly with respect to the plane where the first hole 133 is located. In a plane where the second hole 134 is located, a second inclined surface 136 connected to the plane is provided in the direction in which the frame portion 130 is pivoted toward the body portion 110, and the second inclined surface 136 is inclined downwardly with respect to the plane where the second hole 134 is located. When the frame portion 130 frames the lock brake 120 and the body portion 110, the first pin portion 118 of the body portion 110 is slid into the first hole 133 of the frame portion 130 from the first inclined surface 135, and the second pin portion 119 of the body portion 110 is slid into the second hole 134 of the frame portion 130 from the second inclined surface 136.

For example, a spring may be provided between the first pin portion 118 and the second pin portion 119. Alternatively, the first pin portion 118 and the second pin portion 119 are magnetic or are made of a substance that can be attracted by a magnet. The first hole 133 and the second hole 134 are each provided with a magnetic substance or a magnet, which can attract the first pin portion 118 and the second pin portion 119 when the first pin portion 118 is inserted into the first hole 133 and the second pin portion 119 is inserted into the second hole 134.

As shown in FIGS. 46 and 47, a state in which the connection lock 100 is completely closed is shown. Conversely, the connection lock 100 may be opened from the fully closed state until the fully opened state as shown in FIG. 9. As shown in FIGS. 6 to 9, the process of opening the connection lock 100 is shown. First, the first pin portion 118 is slid out of the first hole 133 while the second pin portion 119 is slid out of the second hole 134, so that the second end 132 of the frame portion 130 is lifted and disengaged from the first end 116 of the body portion 110, that is, the first end 131 of the frame portion 130 starts to pivot about the second end 122 of the lock brake 120. Then, the first end 121 of the lock brake 120 starts to pivot about the first end 116 of the body portion 110, and the second end 122 of the lock brake 120 is lifted and disengaged from the second end 117 of the body portion 110, thereby fully opening the connection lock 100.

Figure 1:
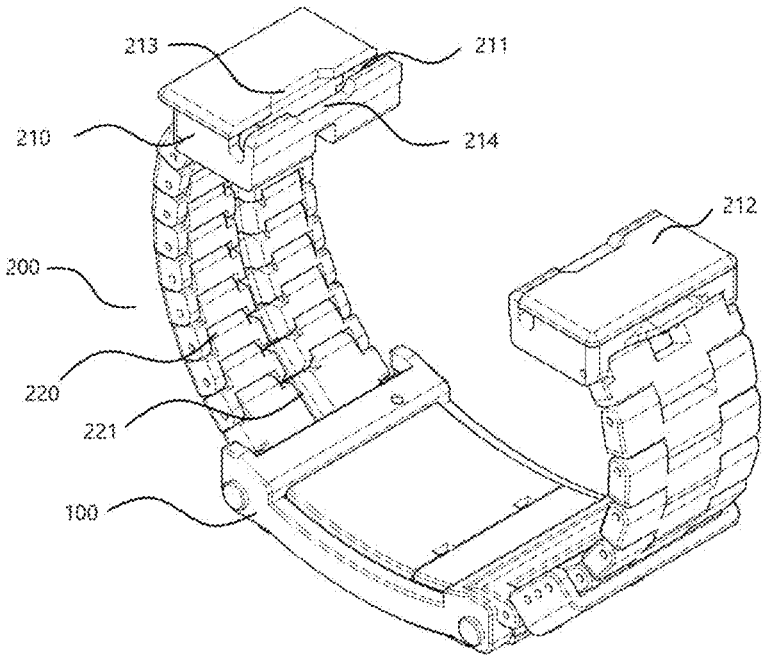
FIG. 1 shows a schematic view of a watch bracelet assembly according to an embodiment of the present invention.

In an exemplary implementation, FIG. 1 shows a schematic view of a watch bracelet assembly 200 according to an embodiment of the present invention. The watch bracelet assembly 200 provided in the embodiment of the present invention includes bracelet straps 220 and a connection lock 100. Two sides of the connection lock 100 are each connected to one bracelet strap 220 (the end of the bracelet strap 220 connected to the connection lock 100 is a first end, and the end of the bracelet strap 220 away from the connection lock 100 is a second end), and the other end (second end) of each of the two bracelet straps 220 is connected to a watch body 500 via a grooved bracelet fastener 210. One of the bracelet strap 220 is provided with a receiving groove 221, the connection lock 100 is the connection lock 100 of the aforementioned embodiment, and the notch 114 of the connection lock 100 matches the receiving groove 221 of the bracelet strap 220.

Figure 2:
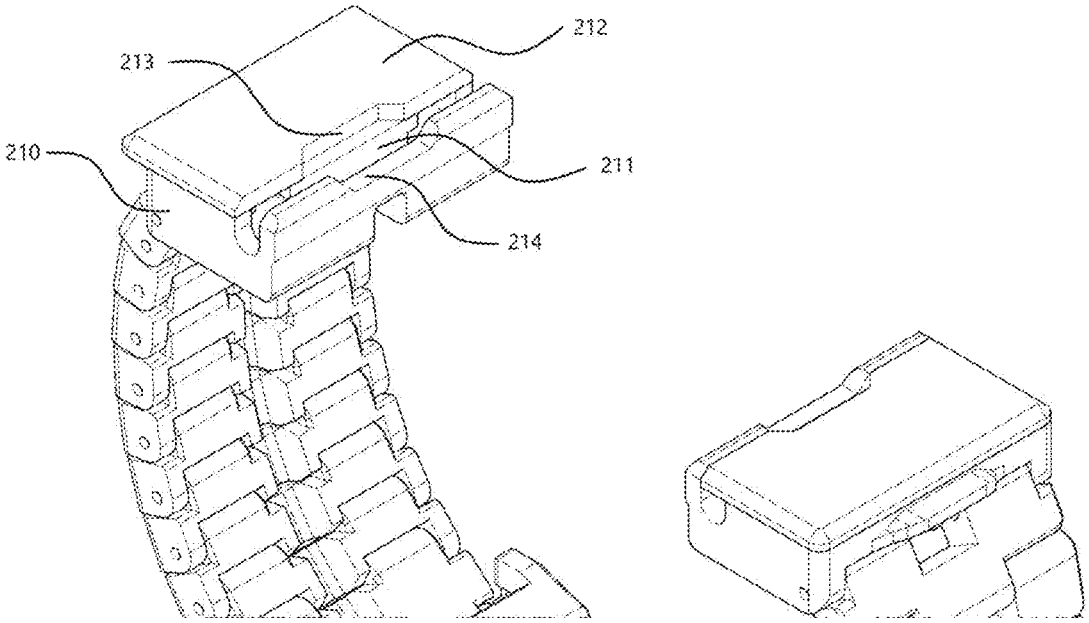
FIG. 2 shows a schematic view of a sliding elastic cover of a grooved bracelet fastener for opening and closing a shaft groove according to an embodiment of the present invention.
Figure 3:
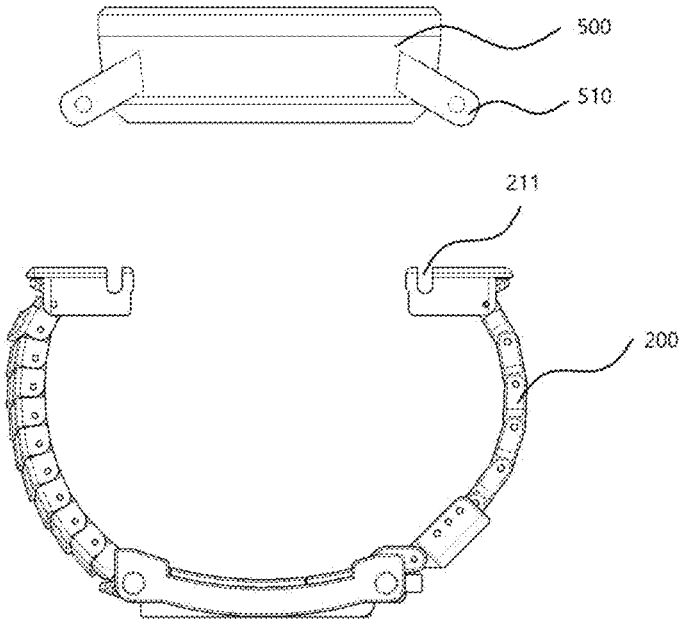
FIG. 3 shows a front view of a watch body ready to connect to a watch bracelet assembly according to an embodiment of the present invention.
Figure 4:
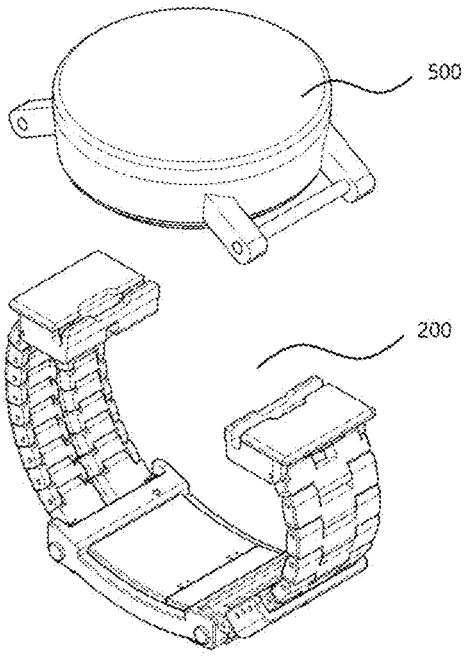
FIG. 4 shows a perspective view of a watch body ready to connect to a watch bracelet assembly according to an embodiment of the present invention.
Figure 5:
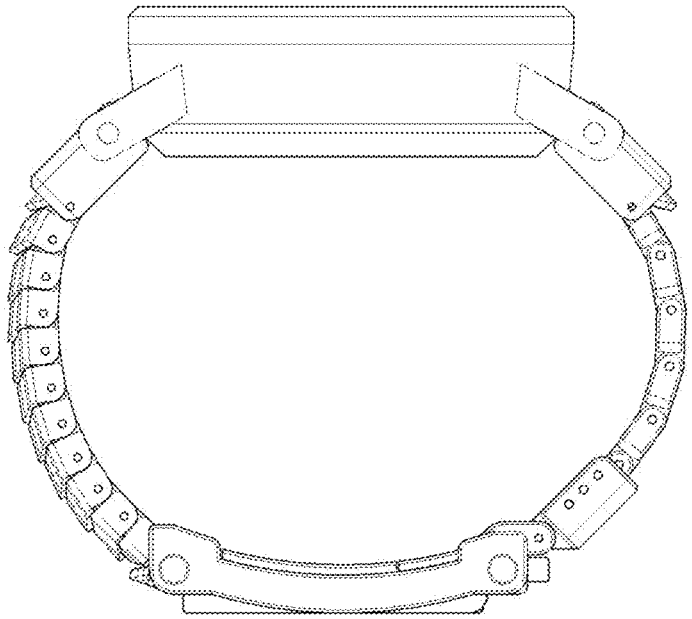
FIG. 5 shows a front view of a watch body that has been connected to a watch bracelet assembly according to an embodiment of the present invention.
Figure 6:
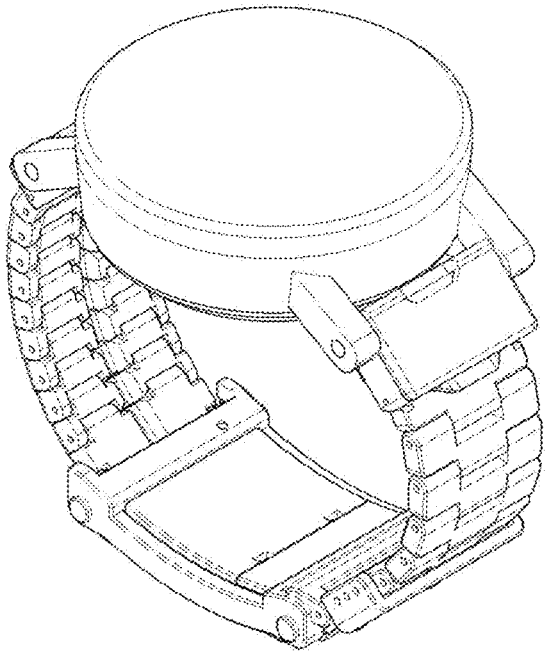
FIG. 6 shows a perspective view of a watch body that has been connected to a watch bracelet assembly according to an embodiment of the present invention.
Figure 7:
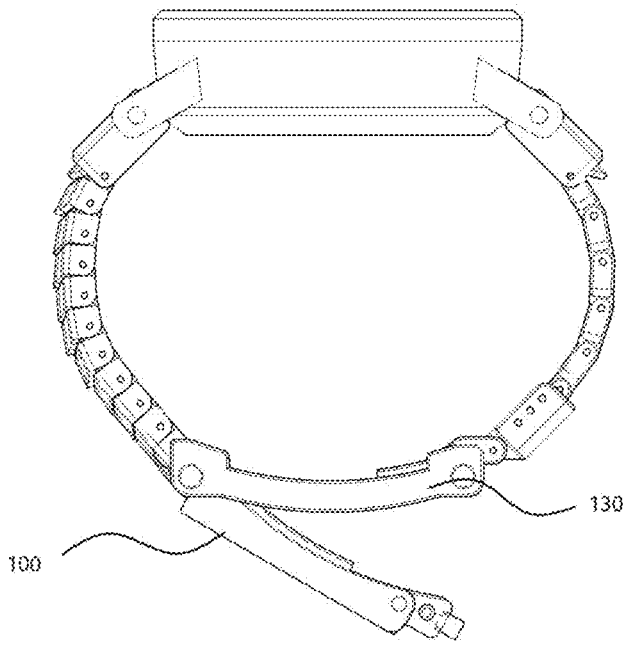
FIG. 7 shows a front view of a connection lock opened from a frame portion according to an embodiment of the present invention.
Figure 8:
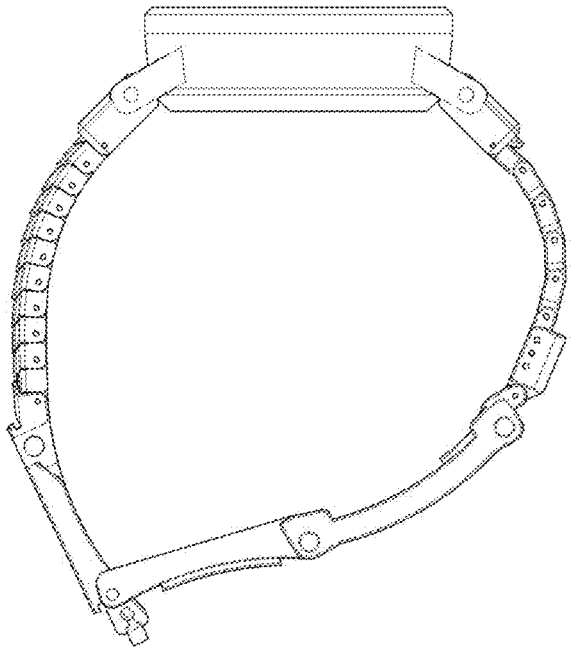
FIG. 8 shows a front view of a connection lock after being fully opened according to an embodiment of the present invention.

As shown in FIG. 2, the end (second end) of the bracelet strap away from the connection lock 100 in the watch bracelet assembly 200 is provided with a grooved bracelet fastener 210 for fastening the watch body 500. A rear part of the grooved bracelet fastener 210 is connected to the second end of the bracelet strap 220, and a front part of the grooved bracelet fastener 210 is connected to the watch body 500. The grooved bracelet fastener 210 is provided with a shaft groove 211 which transversely penetrates the front part of the grooved bracelet fastener 210 and which is recessed downwardly along an upper surface of the grooved bracelet fastener 210, and a sliding elastic cover 212 arranged above the shaft groove 211. The sliding elastic cover 212 is configured to open or close the shaft groove 211. The sliding elastic cover 212 is pulled toward the rear part of the grooved bracelet fastener 210 to expose the shaft groove 211, so that a connection shaft 510 of the watch body can be embedded into the shaft groove 211. Then, the sliding elastic cover 212 is released, and the sliding elastic cover 212 bounces back toward the front part of the grooved bracelet fastener 210 to cover the shaft groove 211, thereby connecting the connection shaft 510 of the watch body 500 to the shaft groove 211.

In some embodiments, the sliding elastic cover 212 may be provided with a first opening 213 at an intermediate position of the shaft groove 211. When the connection shaft 510 of the watch body 500 is fastened in the shaft groove 211, an intermediate portion of the connection shaft 510 may extend outwardly from the intermediate position of the shaft groove 211, pass through the first opening 213 of the sliding elastic cover 212 and be connected to the watch body 500.

In order to align an intermediate horizontal line of the grooved bracelet fastener 210 of the horizontally placed bracelet strap 220 with an intermediate horizontal line of the horizontally placed watch body 500, a sidewall of the shaft groove 211 close to the watch body 500 is provided with a second recessed opening 214 corresponding to the first opening 213 of the sliding elastic cover 212. Edges of the first opening 213 and the second opening 214 are aligned with each other when the sliding elastic cover 212 covers the shaft groove 211. In this way, when it is necessary to open the sliding elastic cover 212, since the first opening 213 and the second opening 214 form a recess, it is convenient for a user to pull the slide cover 212 backward by hand, so that the shaft groove 211 can be exposed.

An embodiment of the present invention further provides an external fitting 300, including a body 330 of the external fitting 300, a connection portion 320 provided on a surface of the body 330 of the external fitting 300, and at least two sliding portions 310 corresponding to sliding connection portions 112 of a connection lock 100. When the external fitting 300 is inserted into the connection lock 100 as described in any one of the previous embodiments, the sliding portions 310 are respectively slid into respective sliding connection portions 112 connected to the connection lock 100, and the connection portion 320 is slid in from the connection opening 113 of the connection lock 100. The connection portion 320 is a connection component, which is connected to the flexible tube or the cable 400 in the receiving cavity 111 at the position of the connection opening 113 of the connection lock 100. Alternatively, the connection portion is slid into the connection opening 113 in a state where it is connected to the flexible tube or the cable 400.

Taking a split device including a watch body 500 and a charging device as an example, the charging device serving as an external fitting 300, the process of mounting a smart watch in a watch bracelet assembly 200 will be described.

Figure 11:
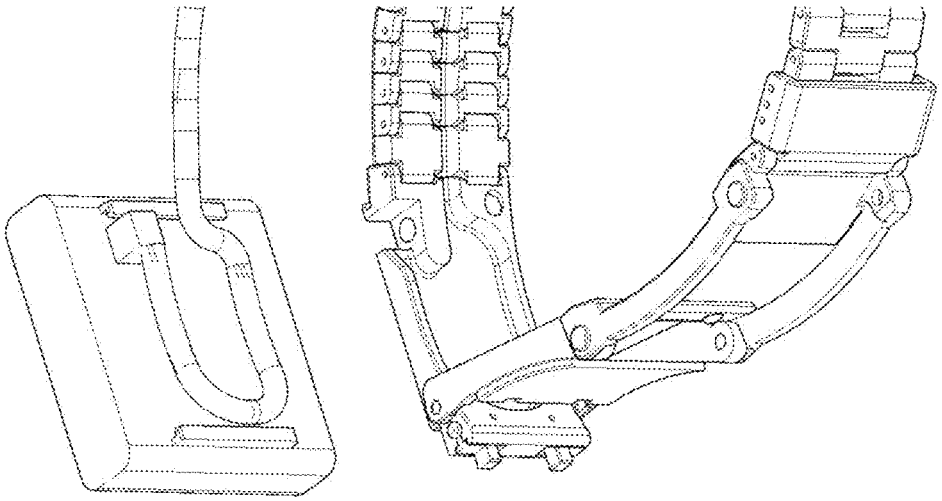
FIG. 11 shows a perspective view of an external fitting ready to be mounted to a watch bracelet assembly according to an embodiment of the present invention.
Figure 12:
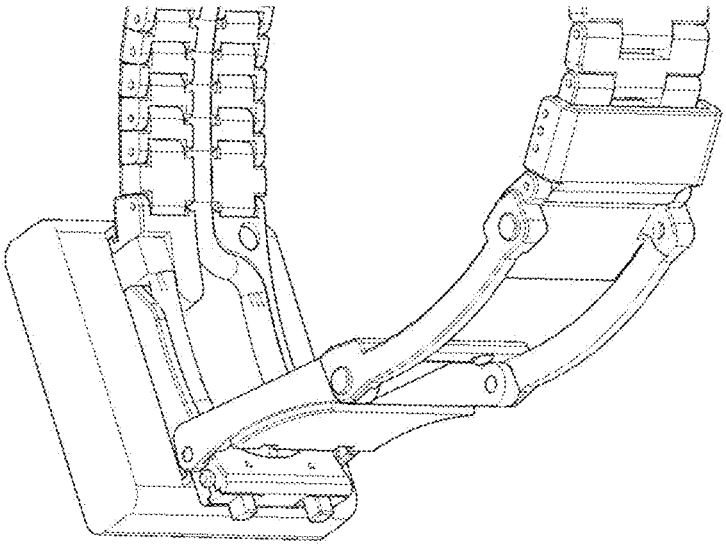
FIG. 12 shows a perspective view of an external fitting that has been mounted in a body portion of a connection lock according to an embodiment of the present invention.
Figure 13:
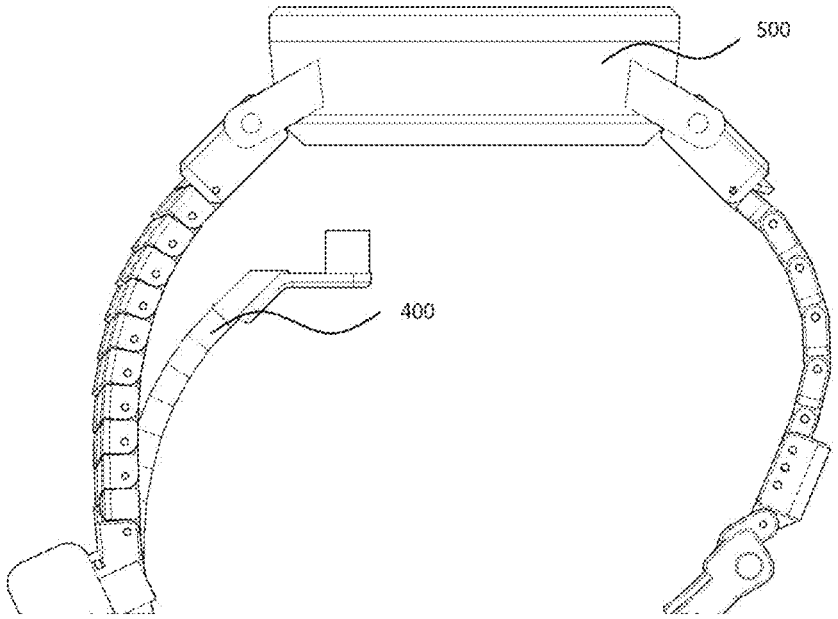
FIG. 13 shows a front view of a cable/flexible tube connector ready to be inserted into a watch according to an embodiment of the present invention.
Figure 14:
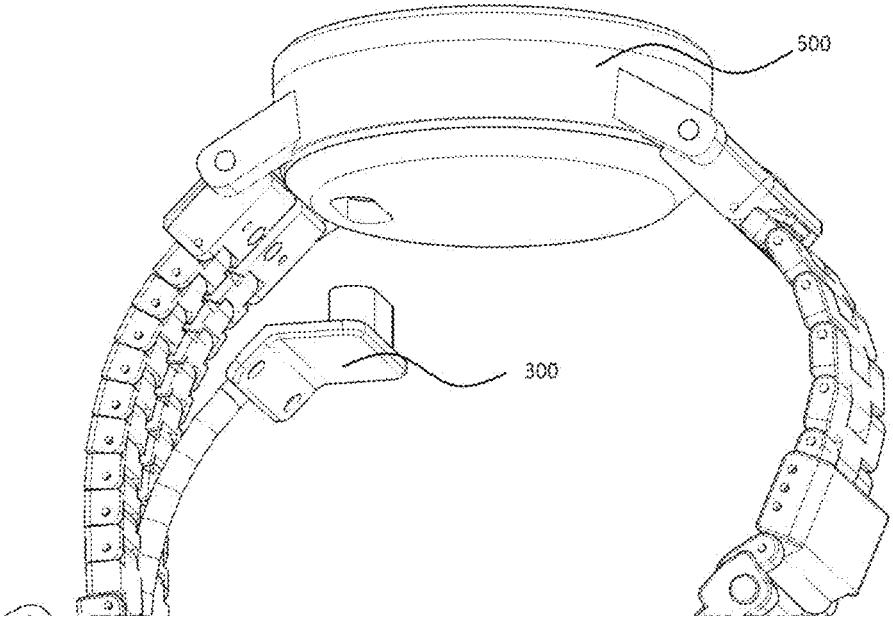
FIG. 14 shows a perspective view of a cable/flexible tube connector ready to be inserted into a watch according to an embodiment of the present invention.
Figure 15:
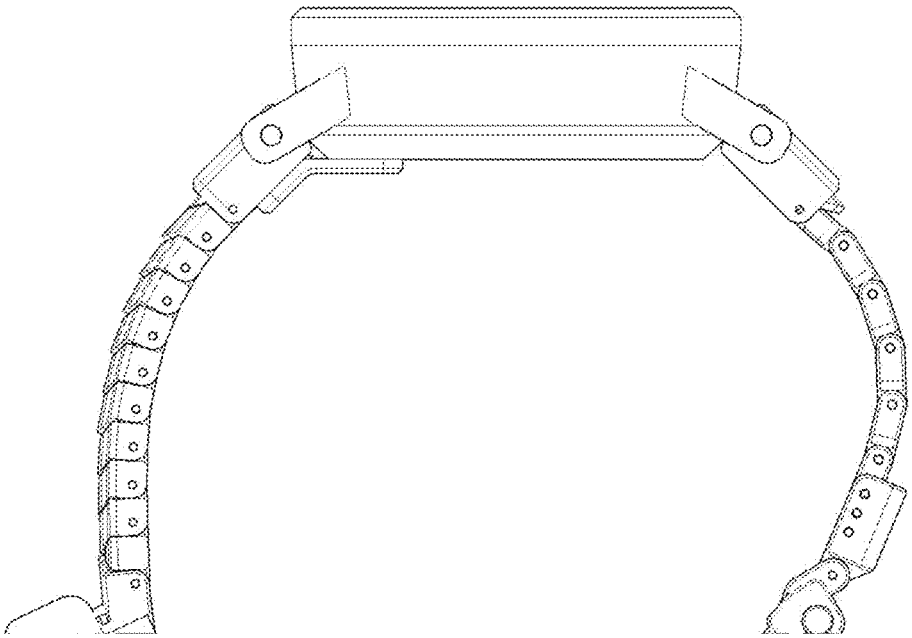
FIG. 15 shows a front view of a cable/flexible tube connector ready that has been inserted into a watch according to an embodiment of the present invention.
Figure 16:
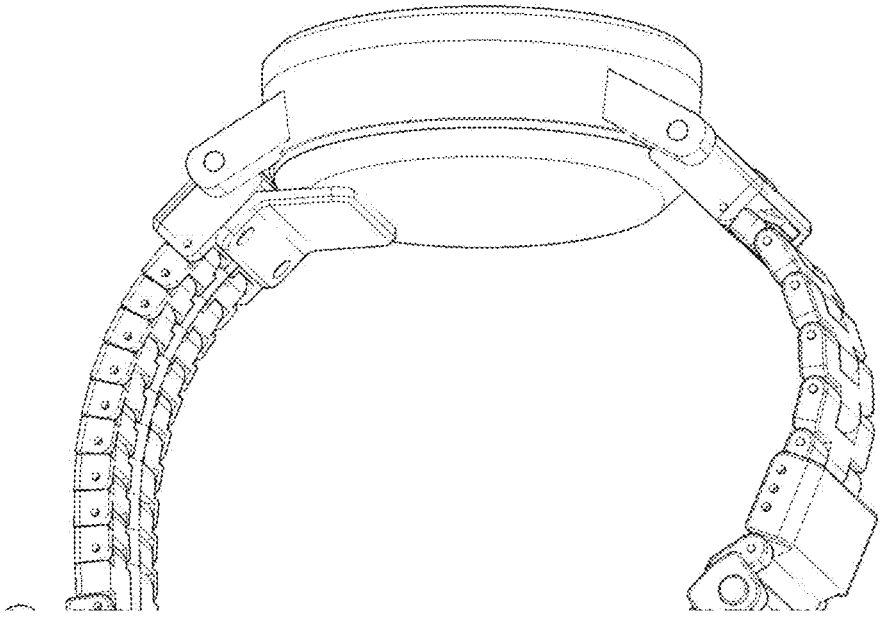
FIG. 16 shows a perspective view of a cable/flexible tube connector ready that has been inserted into a watch according to an embodiment of the present invention.
Figure 17:
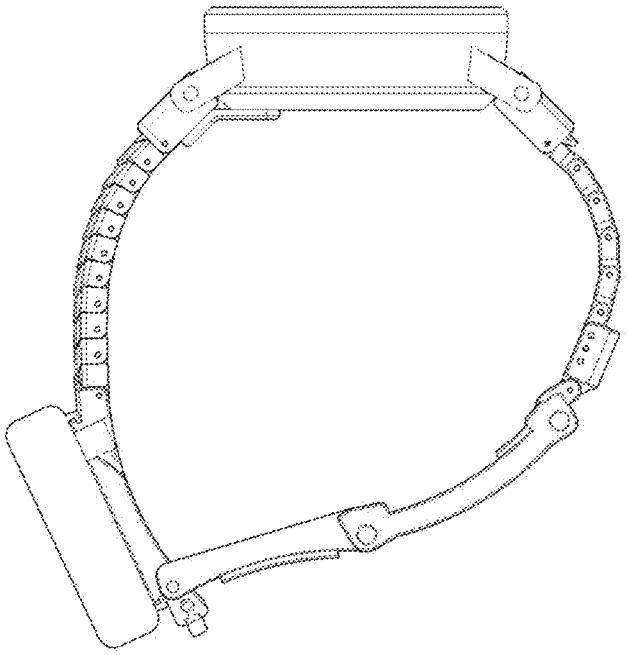
FIG. 17 shows a front view of a fully-opened connection lock to which an external fitting is mounted according to an embodiment of the present invention.

In an embodiment of the present invention, a connection opening 113 with an inclined edge is additionally provided in a side border of a body portion 110 of a connection lock 100, a sliding connection portion 112 is additionally provided at the bottom of each of two opposite side borders of the body portion 110 perpendicular to the border where the connection opening 113 is located, and the charging device is provided with two sliding rails 310 and a cable/flexible tube connection portion 320. As shown in FIGS. 10 to 12, the charging device is slid transversely into the bottom of the body portion 110, the cable/flexible tube connection portion 320 of the charging device is inserted into the connection opening 113 of the body portion 110, and the two sliding rails 310 of the charging device are respectively inserted into the sliding connection portions 112 at two ends of the bottom of the body portion 110. As shown in FIGS. 38 to 41, the sliding connection portions 112 and the connection opening 113 are closed by the lock brake 120 of the connection lock 100 to fix the position of the charging device in the connection lock 100. As shown in FIGS. 42 to 47, the frame portion 130 of the connection lock 100 is closed. The charging device is further locked on the connection lock 100.

A grooved bracelet fastener 210 is provided at the end of the watch bracelet of the watch bracelet assembly 200 away from the charging device, a shaft groove 211 is provided in an upper portion of the front part of the grooved bracelet fastener 210 close to the watch body 500, and a sliding elastic cover 212 is provided at the top of the grooved bracelet fastener 210 for opening or locking the shaft groove 211 of the grooved bracelet fastener 210. The sliding elastic cover 212 at the top of the grooved bracelet fastener 210 is opened, a connection shaft 510 of the watch body 500 is fitted into the shaft groove 211, the sliding elastic cover 212 is then released, and the sliding elastic cover 212 bounces back and closes the shaft groove 211, so that the shaft groove 211 is fastened to the connection shaft 510 of the watch body 500. In this way, the watch body 500 is connected in the watch bracelet assembly 200.

The connection lock 100 of the watch bracelet assembly 200 is opened and the cable/flexible tube 400 of the charging device is placed in the receiving cavity 111 of the body portion 110. One end of the cable/flexible tube 400 is connected to the cable/flexible tube connection portion 320 of the external fitting 300 mounted on the connection lock 100, and the other end of the cable/flexible tube passes through the notch 114 of the body portion 110 into the receiving groove 221 of the watch bracelet assembly 200, and extends along the receiving groove 221 out of the bottom of the grooved bracelet fastener 210 and is connected to the watch body 500. If the other end of the cable/flexible tube 400 can be connected to the wireless charging board, the part of the wireless charging board connected to the cable/flexible tube 400 is mounted to the bottom of the grooved bracelet fastener 210, and the body of the wireless charging board is located at the bottom of the watch body 500.

Taking a split device being a wrist-worn spray device as an example, the process of mounting the wrist-worn spray device will be described below.

The spray device includes two main bodies one of which is an external fitting 300 configured to spray a liquid and mounted on a connection lock 100 of a watch bracelet assembly 200. The other main body 500 is configured to load a compressed gas liquid. Liquid compressed gas is transmitted between the two main bodies through a flexible tube 400, so that the flexible tube 400 between the two main bodies remains connected to avoid leakage of the compressed gas liquid due to dismounting of the flexible tube 400.

First, the watch body, the charging device and the cable/flexible tube are removed from the watch bracelet assembly 200. The main body 500 configured to load the compressed gas liquid is then fastened in the grooved bracelet fastener 210 of the watch bracelet assembly 200 and the external fitting 300 configured to spray the liquid is inserted into the bottom of the connection lock 100. Finally, the flexible tube 400 is organized in a connection passage (the connection opening 113, the receiving cavity 111 and the notch 114 of the body portion 110, and the receiving groove 221 in the watch bracelet). During the whole mounting process, the two main bodies of the spray device are connected to each other, and the inside compressed gas liquid will not leak out.

In the description of this specification, it should be understood that, descriptions relating to orientation, for example, orientation or positional relationships indicated by "center", "longitudinal", "lateral", "length", "width", "thickness", "up", "down", "front", "back", "left", "right", "vertical", "horizontal", "top", "bottom", "inside", "outside", "clockwise", "counterclockwise" "axial", "radial", "circumferential", etc. are based on the orientation or positional relationships shown in the accompanying drawings, and are to facilitate the description of the present invention and simplify the description only, rather than indicate or imply that the device or element mentioned must have a specific orientation or be constructed and operated in a specific orientation, and therefore cannot be construed as limiting the present invention.

In addition, the terms "first" and "second" are for the purpose of description only and should not be construed as indicating or implying relative importance or implicitly indicating the number of technical features indicated. Thus, features defined with "first" and "second" may include one or more of the features either explicitly or implicitly. In the description of the present invention, the term "plurality" means two or more, unless otherwise explicitly and specifically defined.

In the present invention, terms such as "mount", "engage", "connect" and "fix" should be interpreted in a broad sense unless explicitly defined and limited otherwise, which, for example, may mean a fixed connection, a detachable connection or being integrally formed; may mean a mechanical connection, an electrical connection, or a communicative connection; or may mean a direct connection, an indirect connection by means of an intermediary, or internal communication between two elements or an interaction relationship between two elements. For those of ordinary skill in the art, the specific meaning of the terms mentioned above in the present invention should be construed according to specific circumstances.

In the present invention, unless otherwise explicitly specified or defined, a first feature being "on" or "under" a second feature can include situations where the first feature is in direct contact with the second feature, and can also include situations where the first and second features are in indirect contact by means of another feature therebetween, instead of being in direct contact with each other. Moreover, a first feature being "on", "above" or "over" a second feature includes situations where the first feature is directly above or obliquely above the second feature, or simply indicates that the first feature is higher in level than the second feature. A first feature being "under", "below" or "underneath" a second feature includes situations where the first feature is directly below or obliquely below the second feature, or simply indicates that the first feature is lower in level than the second feature.

The disclosure above provides many different embodiments or examples for implementing different structures of the present invention. In order to simplify the disclosure of the present invention, the components and arrangements of specific examples are described above. Of course, they are only examples and are not intended to limit the present invention. Furthermore, reference numbers and/or letters may be repeated in different examples of the present invention. Such repetitions are for simplification and clearness, which per se do not indicate the relations of the discussed embodiments and/or arrangements.

Only particular embodiments of the present invention are described above, and the scope of protection of the present invention is not limited thereto. Various changes or substitutions that can be readily conceived by those skilled in the art within the technical scope disclosed by the present invention shall fall within the scope of protection of the present invention. Therefore, the scope of protection of the present inventive should be subject to the scope of protection of the claims.

The invention claimed is:

1. A connection lock for connection with a watch bracelet, the connection lock comprising a body portion, the body portion comprising:

a receiving cavity is enclosed by a peripheral border of the body portion to receive a spare length of flexible tube or cable; the peripheral border of the body portion having a first side border, a second side border, a third side border, and a fourth side border connected in sequence; the first side border for connection with a bracelet strap, the bracelet strap has a receiving groove, the first side border includin a notch capable of aligning and communication with the receiving groove in the bracelet strap, so as to enable the flexible tube or the cable in the receiving cavity to pass into the receiving groove of the bracelet strap via the notch in the first side border;

at least two sliding connection portions respectively arranged at lower edges of the second side border and the fourth side border; the second side border and the fourth side border are arranged orthogonally to the first side border; the third side border oppositely located to the first side border and orthogonal to the second side border and the fourth side border; and a connection opening arranged, adjacent to the notch, on the second side border of the body portion perpendicular to the sliding connection portions, wherein when an external fitting is connected to the flexible tube or the cable by sliding it onto the connection lock via the sliding connection portion of the connection lock and a sliding portion of the external fitting, a connection portion of the external fitting is slidable in from the connection opening such that the connection portion is connected to the flexible tube or the cable in the receiving cavity.

2. The connection lock of claim 1, wherein a bottom of the connection opening is provided with a stopper having a first end close to the notch, a second end close to the connection opening, and a semicircular arc-shaped third end extending to a side opposite to the notch, so as to enable the flexible tube or the cable to be flexed into a U-shape to a minimum extent in the receiving cavity.

3. The connection lock of claim 2, wherein the stopper is magnetic.

4. The connection lock of claim 1, wherein the sliding connection portion is a sliding groove, and the sliding portion is a sliding rail; or the sliding connection portion is a sliding rail, and the sliding portion is a sliding groove; or the sliding connection portion and the sliding portion are linear sliding connection structures having interlocking shapes.

5. The connection lock of claim 1, further comprising a lock brake for covering the body portion, wherein a first end of the lock brake is pivotally connected to a first end of the body portion, the first end of the body portion is configured for connection with the bracelet strap of the watch bracelet, and two side borders of the lock brake perpendicular to the sliding connection portions are provided with stop plates extending downwardly perpendicular to a cover surface of the lock brake; and when the lock brake covers a top of the receiving cavity of the body portion, the stop plates cover two ends of the two sliding connection portions.

6. The connection lock of claim 5, wherein when the lock brake covers the top of the receiving cavity of the body portion, the stop plates further cover the connection opening.

7. The connection lock of claim 5, further comprising a frame portion provided with a peripheral borders, wherein a first end of the frame portion is pivotally connected to a second end of the lock brake; and after the lock brake covers the top of the receiving cavity of the body portion, the frame portion is pivotable about the second end of the lock brake to enclose the lock brake and the body portion, and a second end of the frame portion is detachably connected to the first end of the body portion.

8. The connection lock of claim 7, wherein a first pin portion and a second pin portion are respectively provided on two sides of the first end of the body portion, and a first hole corresponding to the first pin portion and a second hole corresponding to the second pin portion are respectively provided on two sides of the second end of the frame portion; and when the frame portion is pivoted about the second end of the lock brake to enclose the lock brake and the body portion, the first pin portion of the body portion is inserted into the first hole of the frame portion, and the second pin portion of the body portion is inserted into the second hole of the frame portion.

9. The connection lock of claim 8, wherein a first inclined surface is provided in a plane where the first hole is located in a direction in which the frame portion is pivoted toward the body portion, the first inclined surface being connected to the plane and inclined downwardly relative to the plane; a second inclined surface is provided in a plane where the second hole is located in the direction in which the frame portion is pivoted toward the body portion, the second inclined surface being connected to the plane and inclined downwardly relative to the plane; and when the frame portion encloses the lock brake and the body portion, the first pin portion of the body portion is slid into the first hole of the frame portion from the first inclined surface, and the second pin portion of the body portion is slid into the second hole of the frame portion from the second inclined surface.

10. A watch bracelet, comprising at least one bracelet strap and the connection lock of any one of claims 1 to 9, wherein the at least one bracelet strap is provided with a receiving groove, an end of the connection lock provided with a notch is connected to a first end of the at least one bracelet strap, and the notch of the connection lock is in alignment with the receiving groove of the bracelet strap.

11. The watch bracelet of claim 10, further comprising a grooved bracelet fastener, a rear part of the grooved bracelet fastener being connected to a second end of the bracelet strap, and the grooved bracelet fastener being provided with a shaft groove which transversely penetrates a front part of the grooved bracelet fastener and which is recessed downwardly along an upper surface of the grooved bracelet fastener, and a sliding elastic cover arranged above the shaft groove, wherein the sliding elastic cover is configured to open or close the shaft groove, and the shaft groove is configured to accommodate a connection shaft of a watch body.

12. An external fitting, comprising: a body of the external fitting, a connection portion arranged on a surface of the body of the external fitting, and at least two sliding portions corresponding to the at least two sliding connection portions of the connection lock of any one of claims 1 to 9, wherein when the sliding portions of the external fitting are slid and connected to the sliding connection portions of the connection lock, the connection portion is slidable in from the connection opening of the connection lock.

* * * * *